US008648685B2

(12) United States Patent
Cheon et al.

(10) Patent No.: US 8,648,685 B2
(45) **Date of Patent: *Feb. 11, 2014**

(54) TRANSFORMER AND FLAT PANEL DISPLAY DEVICE INCLUDING THE SAME

(75) Inventors: Myeong Sik Cheon, Gyunggi-do (KR); Sang Joon Seo, Gyunggi-do (KR); Geun Young Park, Gyunggi-do (KR); Deuk Hoon Kim, Gyunggi-do (KR); Hwi Beom Shin, Gyeongsangnam-do (KR); Young Min Lee, Gyunggi-do (KR); Jong Hae Kim, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/175,640

(22) Filed: Jul. 1, 2011

(65) Prior Publication Data

US 2012/0001886 A1 Jan. 5, 2012

(30) Foreign Application Priority Data

Jul. 2, 2010 (KR) ..... 10-2010-0063720
Dec. 29, 2010 (KR) ..... 10-2010-0138336
Jun. 14, 2011 (KR) ..... 10-2011-0057273

(51) Int. Cl.
*H01F 27/30* (2006.01)

(52) U.S. Cl.
USPC ..... 336/198

(58) Field of Classification Search
USPC ..... 336/198, 65, 83, 196, 200, 206–208, 336/232
See application file for complete search history.

(56) References Cited

U.S. PATENT DOCUMENTS 3,652,968 A 3/1972 Johnston et al.
3,946,350 A 3/1976 Goto
3,958,328 A 5/1976 Lee
4,250,479 A 2/1981 Bausch et al.

(Continued)

FOREIGN PATENT DOCUMENTS

CN 1497296 A 5/2004
CN 1514424 A 7/2004

(Continued)

OTHER PUBLICATIONS

Japanese Office Action issued in Japanese Patent Application No. 2011-147692 dated Jun. 5, 2012.

(Continued)

*Primary Examiner* — Tuyen Nguyen
(74) *Attorney, Agent, or Firm* — McDermott Will & Emery LLP

(57) ABSTRACT

There are provided a thin transformer capable of being used in a slim display device such as a liquid crystal display (LCD) device and a light emitting diode (LED) display device, and a flat panel display device including the same. The transformer includes: a bobbin part including a plurality of bobbins, each including a pipe shaped body part having a though-hole formed in an inner part thereof and a flange part protruding outwardly from both ends of the body part; coils respectively wound around the bobbins; and a core electromagnetically coupled to the coils to thereby form a magnetic path, wherein at least one of the bobbins includes a coil skip part which is a route through which lead wires of the coil skipped through the flange part is disposed on an outer surface of the flange part.

15 Claims, 11 Drawing Sheets

(56) References Cited

U.S. PATENT DOCUMENTS

| | | | | |
|---|---|---|---|---|
| 4,596,974 | A | 6/1986 | Tobben et al. | |
| 4,857,878 | A | 8/1989 | Eng, Jr. et al. | |
| 4,967,121 | A | 10/1990 | Nero | |
| 5,534,839 | A | 7/1996 | Mackin et al. | |
| 5,673,013 | A | 9/1997 | Moody et al. | 336/192 |
| 5,726,616 | A | 3/1998 | Bell | |
| 5,996,214 | A | 12/1999 | Bell | |
| 6,046,663 | A | 4/2000 | Kubomura et al. | |
| 6,127,912 | A | 10/2000 | Dust et al. | 336/208 |
| 6,344,786 | B1 | 2/2002 | Chin | |
| 6,611,189 | B2 | 8/2003 | Sigl | |
| 6,900,717 | B2 | 5/2005 | Timashov et al. | |
| 8,018,314 | B2 | 9/2011 | Zeng et al. | |
| 2003/0030531 | A1 | 2/2003 | Okano et al. | |
| 2004/0125065 | A1 | 7/2004 | Park et al. | |
| 2004/0224598 | A1 | 11/2004 | Tanaka | |
| 2005/0275498 | A1* | 12/2005 | Haga | 336/208 |
| 2006/0255898 | A1* | 11/2006 | Sawazaki et al. | 336/90 |
| 2007/0165151 | A1 | 7/2007 | Lee et al. | |
| 2007/0273466 | A1* | 11/2007 | Yang et al. | 336/220 |
| 2008/0180205 | A1 | 7/2008 | Tsai et al. | |
| 2009/0237195 | A1 | 9/2009 | Zeng et al. | 336/196 |

FOREIGN PATENT DOCUMENTS

| | | | |
|---|---|---|---|
| CN | 1991453 | A | 7/2007 |
| CN | 101241798 | A | 8/2008 |
| CN | 201142269 | Y | 10/2008 |
| CN | 101521095 | A | 9/2009 |
| CN | 101673611 | A | 3/2010 |
| GB | 2112746 | A | 7/1993 |
| JP | 61-133614 | A | 6/1986 |
| JP | 61-140515 | | 8/1986 |
| JP | 62005622 | A | 1/1987 |
| JP | 63-170915 | | 11/1988 |
| JP | 1156523 | U | 10/1989 |
| JP | 03-279167 | B2 | 12/1991 |
| JP | 03284807 | A | 12/1991 |
| JP | 05-038845 | | 2/1993 |
| JP | 5-66935 | U | 9/1993 |
| JP | 05283248 | A | 10/1993 |
| JP | 5-304033 | A | 11/1993 |
| JP | 5-90928 | U | 12/1993 |
| JP | 06-013124 | | 1/1994 |
| JP | 6-112058 | A | 4/1994 |
| JP | 06-295828 | | 10/1994 |
| JP | 7-022526 | A | 1/1995 |
| JP | 07-106158 | A | 4/1995 |
| JP | 07-326524 | A | 12/1995 |
| JP | 08-069928 | A | 3/1996 |
| JP | 08-153630 | A | 6/1996 |
| JP | 09-129457 | | 5/1997 |
| JP | 2569842 | | 2/1998 |
| JP | 2001-250728 | | 9/2001 |
| JP | 2001-305972 | A | 11/2001 |
| JP | 2001-350133 | A | 12/2001 |
| JP | 2002-313641 | A | 10/2002 |
| JP | 3454801 | | 7/2003 |
| JP | 2005-158927 | | 6/2005 |
| JP | 2009-117660 | | 5/2009 |
| KR | 10-2004-0101697 | A | 12/2004 |
| KR | 10-2006403556 | A | 4/2006 |

OTHER PUBLICATIONS

United States Office Action issued in U.S. Appl. No. 13/175,438 dated Aug. 16, 2012.

U.S. Office Action issued in U.S. Appl. No. 13/175,660, mailed Oct. 16, 2012.

Korean Office Action, w/ English translation thereof, issued in Korean Patent Application No. 10-2011-0057273.

United States Office Action issued in U.S. Appl. No. 13/175,471 dated Oct. 9, 2012.

United States Office Action issued in U.S. Appl. No. 13/175,438 dated Feb. 19, 2013.

United States Office Action issued in U.S. Appl. No. 13/175,290 dated Feb. 14, 2013.

US Office Action issued in U.S. Appl. No. 13/175,678 dated Feb. 25, 2013.

Japanese Office Action issued in Japanese Application No. 2011-147753 dated May 7, 2013 with English Translation.

United States Office Action issued in U.S. Appl. No. 13/175,438 dated Jun. 6, 2013.

Japanese Office Action for Patent Application No. 2011-147692 and English abstract dated Mar. 5, 2013.

Japanese Office Action for Patent Application No. 2011-147586 and English abstract dated Mar. 5, 2013.

United States Office Action issued in U.S. Appl. No. 13/175,632 dated Aug. 9, 2013.

Chinese Office Action, w/ English translation thereof, issued in Chinese Patent Application No. CN 201110191489.1 dated Sep. 27, 2013.

Chinese Office Action, w/ English translation thereof, issued in Chinese Patent Application No. CN 201110191334.8 dated Oct. 12, 2013.

Chinese Office Action, w/ English translation thereof, issued in Chinese Patent Application No. CN 201110191452.9 dated Oct. 8, 2013.

Chinese Office Action, w/ English translation thereof, issued in Chinese Patent Application No. CN 201110191128.7 dated Oct. 22, 2013.

* cited by examiner

TRANSFORMER AND FLAT PANEL DISPLAY DEVICE INCLUDING THE SAME

CROSS-REFERENCE TO RELATED APPLICATIONS

This application claims the priority of Korean Patent Application Nos. 10-2010-0063720 filed on Jul. 2, 2010, 10-2010-0138336 filed on Dec. 29, 2010, and 10-2011-0057273 filed on Jun. 14, 2011, in the Korean Intellectual Property Office, the disclosures of which are incorporated herein by references.

BACKGROUND OF THE INVENTION

1. Field of the Invention

The present invention relates to a thin transformer capable of being used in a slim display device such as a liquid crystal display (LCD) device and a light emitting diode (LED) display device, and a flat panel display device including the same.

2. Description of the Related Art

Recently, a flat panel display (FPD) which is a new technology appropriate for a multi-media system having a high resolution and a large-sized screen, or the like, has been prominent in the field of displays, instead of a cathode ray tube (CRT).

Particularly, a slim display such as a liquid crystal display (LCD) television (TV) or a plasma display panel (PDP) TV has been prominent as a large-sized display. In the future, it is expected that the slim display will continuously receive attention in view of the cost and marketability thereof.

A cold cathode fluorescent lamp (CCFL) has been used as a backlight light source in the LCD TV. However, the use of a light emitting diode (LED) has recently been gradually increased due to various advantages in terms of power consumption, life span, environmental friendliness, and the like.

In accordance with the use of the LED, a backlight unit has been miniaturized. As a result, a thickness of a flat TV has gradually been reduced. In addition, the demand for slimness in a power supply module within the flat TV and a transformer mounted in the power supply module has increased.

However, as a thickness of a transformer is reduced, a movement range of a coil wound in the transformer may become significantly narrow, such that it is difficult to lead and connect the coil to external connection terminals.

Particularly, when a plurality of coils are connected to the external connection terminals, a case in which they need to be disposed to intersect with each other has occurred. Therefore, the intersected coils are in contact with each other, whereby an electrical short circuit may occur therebetween.

In the case of the transformer according to the related art, the coils are generally wound perpendicularly to a printed circuit board. In addition, a core is provided in a form in which it forms a magnetic path in parallel with the printed circuit board. Therefore, a magnetic path of a majority of leaked magnetic flux of the transformer is formed through a space between a back cover and the transformer (or a space between the printed circuit board and the transformer).

Accordingly, in the case of the transformer according to the related art, since the leakage magnetic flux is distributed over the space of the back cover and the transformer, when the back cover and the transformer have a narrow interval therebetween in order to allow a display device to be slim, interference is generated between the back cover formed of a metallic material and the leaked magnetic flux, such that noise is generated while the back cover is vibrated.

SUMMARY OF THE INVENTION

An aspect of the present invention provides a thin transformer capable of being used in a slim display device, or the like, and a flat panel display device including the same.

Another object of the present invention provides a transformer in which a plurality of coils may be connected to external connection terminals without being intersected with each other, and a flat panel display device including the same.

According to an aspect of the present invention, there is provided a transformer including: a bobbin part including a plurality of bobbins, each including a pipe shaped body part having a though-hole formed in an inner part thereof and a flange part protruding outwardly from both ends of the body part; coils respectively wound around the bobbins; and a core electromagnetically coupled to the coils to thereby form a magnetic path, wherein at least one of the bobbins includes a coil skip part which is a route through which lead wires of the coil skipped through the flange part is disposed on an outer surface of the flange part.

The coil skip part may include: a skip groove, which is a route through which the lead wires of the coil wound around the body part move to an outer surface of the flange part; and a traversing route, which is a route disposed so that the lead wires skipped through the skip groove traverse a lower surface of the flange part.

Each of the bobbins may include a terminal connection part protruding from one end of at least one flange part and having a plurality of external connection terminals connected thereto.

The coil skip part may be a route formed between the terminal connection part and a guide block protruding from the outer surface of the flange part in parallel with the terminal connection part.

The guide block may have one end protruding outwardly from an outer peripheral edge of the flange part, and the skip groove may be a groove formed by one end of the guide block, the terminal connection part, and the flange part.

The terminal connection part may include a plurality of lead grooves formed in spaces between the external connection terminals, and the plurality of lead wires may be connected to the external connection terminals while passing through the skip groove or the lead groove.

The transformer may further include at least one support protrusion protruding outwardly from the traversing route or the terminal connection part, wherein the lead wires are disposed in a changed direction while supporting the support protrusion.

The support protrusion may protrude in parallel with a plane formed by the flange part.

The support protrusion may protrude perpendicularly to a plane formed by the flange part.

The support protrusion may protrude so that a contact surface between the support protrusion and the lead wire forms a right angle or an acute angle with the flange part.

The guide block may be formed so that a spaced distance between the guide block and the terminal connection part increases corresponding to a position at which the support protrusion is formed.

The support protrusion may include a chamfer formed at a position at which it contacts the lead wire.

The guide block may include a catching groove opened from one end of an outwardly protruding part of the flange part toward the skip groove.

The bobbin part may include: an outer bobbin including the coil skip part; and an inner bobbin inserted into and coupled to the through-hole of the outer bobbin.

According to another aspect of the present invention, there is provided a transformer including: a bobbin part including a plurality of bobbins, each including a pipe shaped body part having a though-hole formed in an inner part thereof and a flange part protruding outwardly from both ends of the body part; external connection terminals connected to one end of at least one of the flange parts; and at least one coil wound in a space formed by an outer peripheral surface of the body part and one surface of the flange part, wherein lead wires of the coil are connected to the external connection terminals while being disposed in a distributed scheme on one surface and the other surface of the flange part in order to prevent an intersection therebetween.

At least one of the bobbins may include a terminal connection part protruding from one end of the flange part and including a plurality of external connection terminals connected thereto and a plurality of lead grooves formed in spaces between the external connection terminals, the lead groove including the lead wire disposed therein.

At least one of the bobbins may include a coil skip part including a skip groove, which is a route through which the lead wires move to an outer surface of the flange part and a traversing route, which is a route disposed so that the lead wires skipped through the skip groove traverse the other surface of the flange part.

According to another aspect of the present invention, there is provided a flat panel display device including: a switching mode power supply including at least one transformer as described above mounted on a substrate thereof; a display panel receiving power from the switching mode power supply; and covers protecting the display panel and the switching mode power supply.

The coils of the transformer may be wound so as to be parallel with the substrate of the switching mode power supply.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Figure 1A:
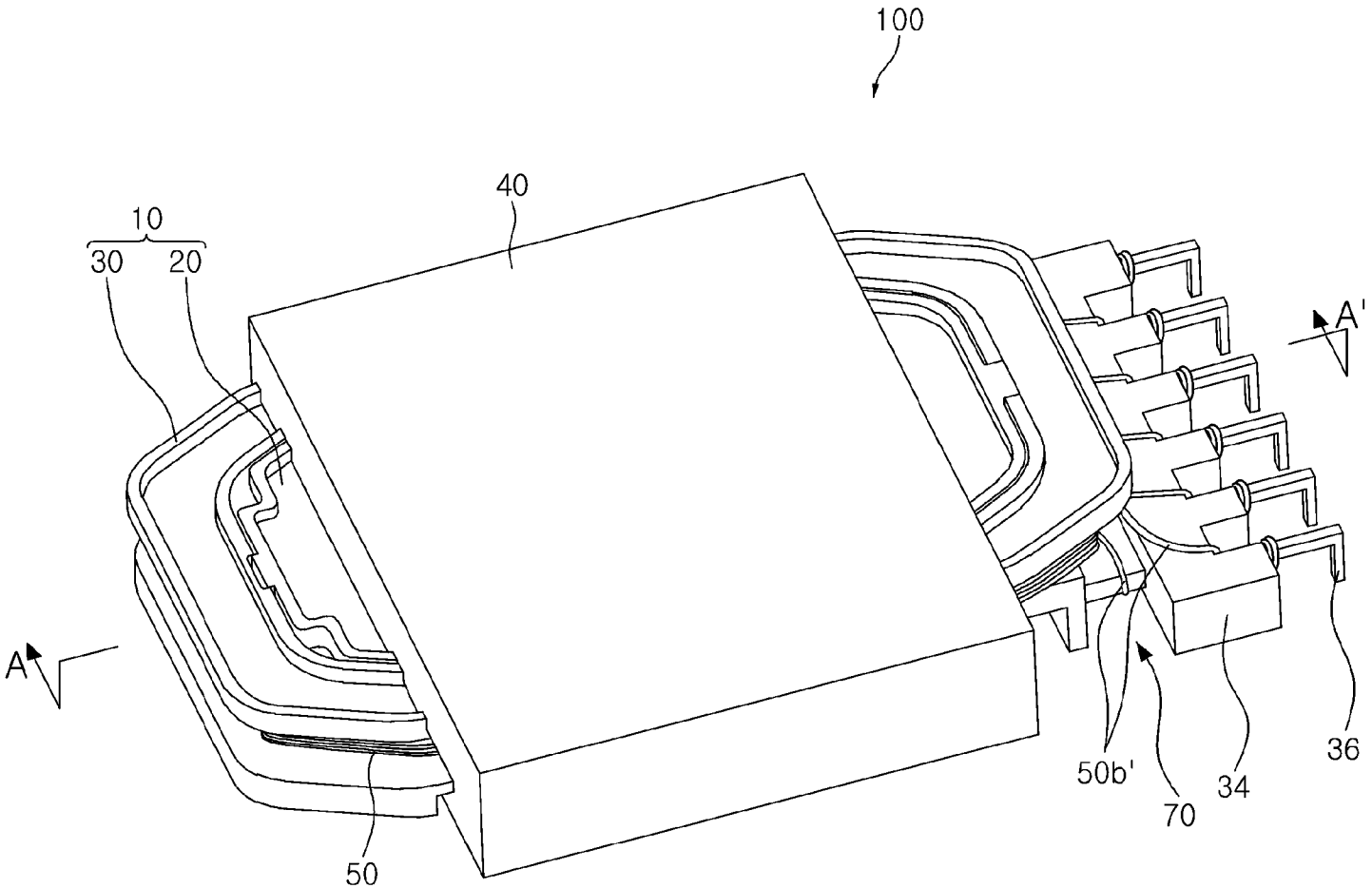
FIGS. 1A and 1B are perspective views schematically showing a transformer according to an embodiment of the present invention.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to most appropriately describe the best method he or she knows for carrying out the invention. Therefore, the configurations described in the embodiments and drawings of the present invention are merely the most preferable embodiments but do not represent all of the technical spirit of the present invention. Thus, the present invention should be construed as including all the changes, equivalents, and substitutions included in the spirit and scope of the present invention at the time of the filing of this application.

Hereinafter, embodiments of the present invention will be described in detail with reference to the accompanying drawings. At this time, it is noted that like reference numerals denote like elements in appreciating the drawings. Moreover, detailed descriptions related to well-known functions or configurations will be ruled out in order not to unnecessarily obscure the subject matter of the present invention. Based on the same reason, it is to be noted that some components shown in the drawings are exaggerated, omitted or schematically illustrated, and the sizes of individual components do not exactly reflect their actual sizes.

Hereinafter, embodiments of the present invention will be described in detail with reference to the accompanying drawings.

Figure 1B:
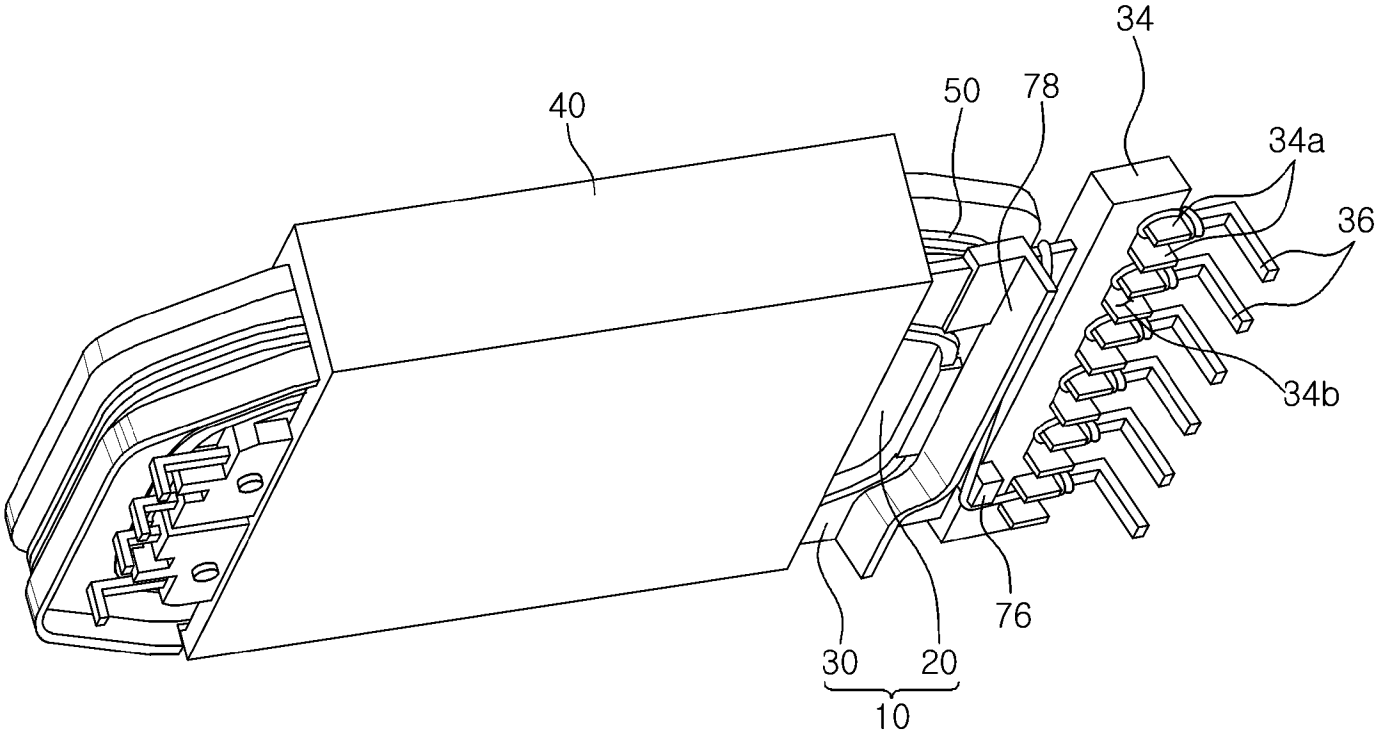
Figure 2:
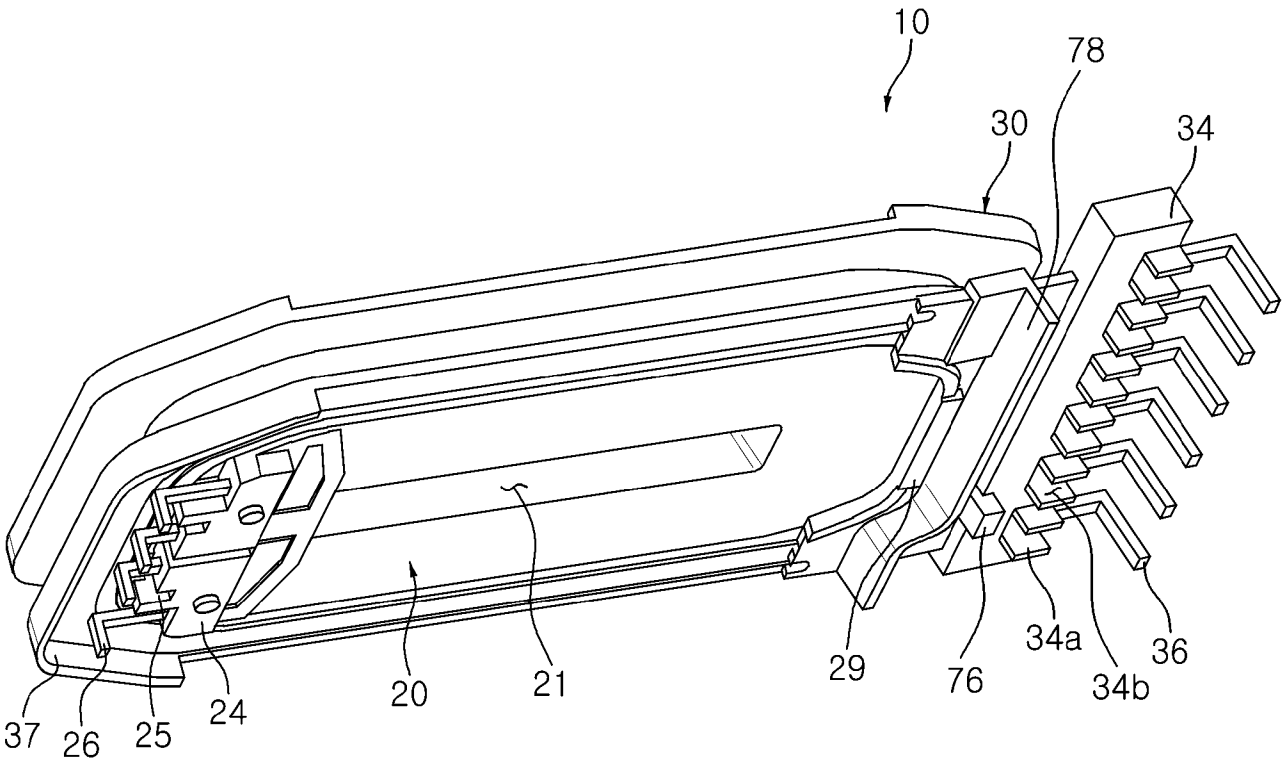
FIG. 2 is a perspective view schematically showing a bobbin part of the transformer shown in FIG. 1B.
Figure 3:
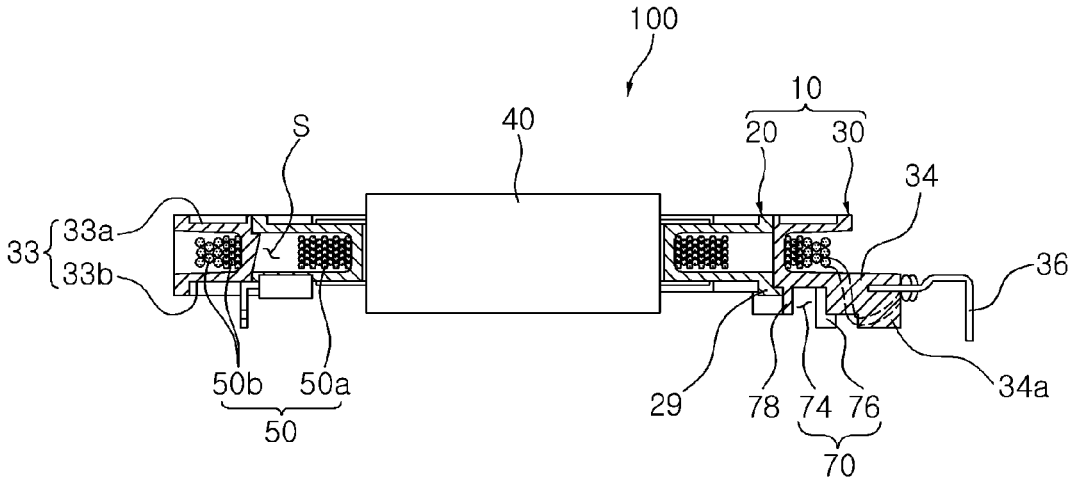
FIG. 3 is a cross-sectional view taken along line A-A' of the transformer shown in FIG. 1A.

FIGS. 1A and 1B are perspective views schematically showing a transformer according to an embodiment of the present invention; FIG. 2 is a perspective view schematically showing a bobbin part of the transformer shown in FIG. 1B; and FIG. 3 is a cross-sectional view taken along line A-A' of the transformer shown in FIG. 1A.

Figure 4:
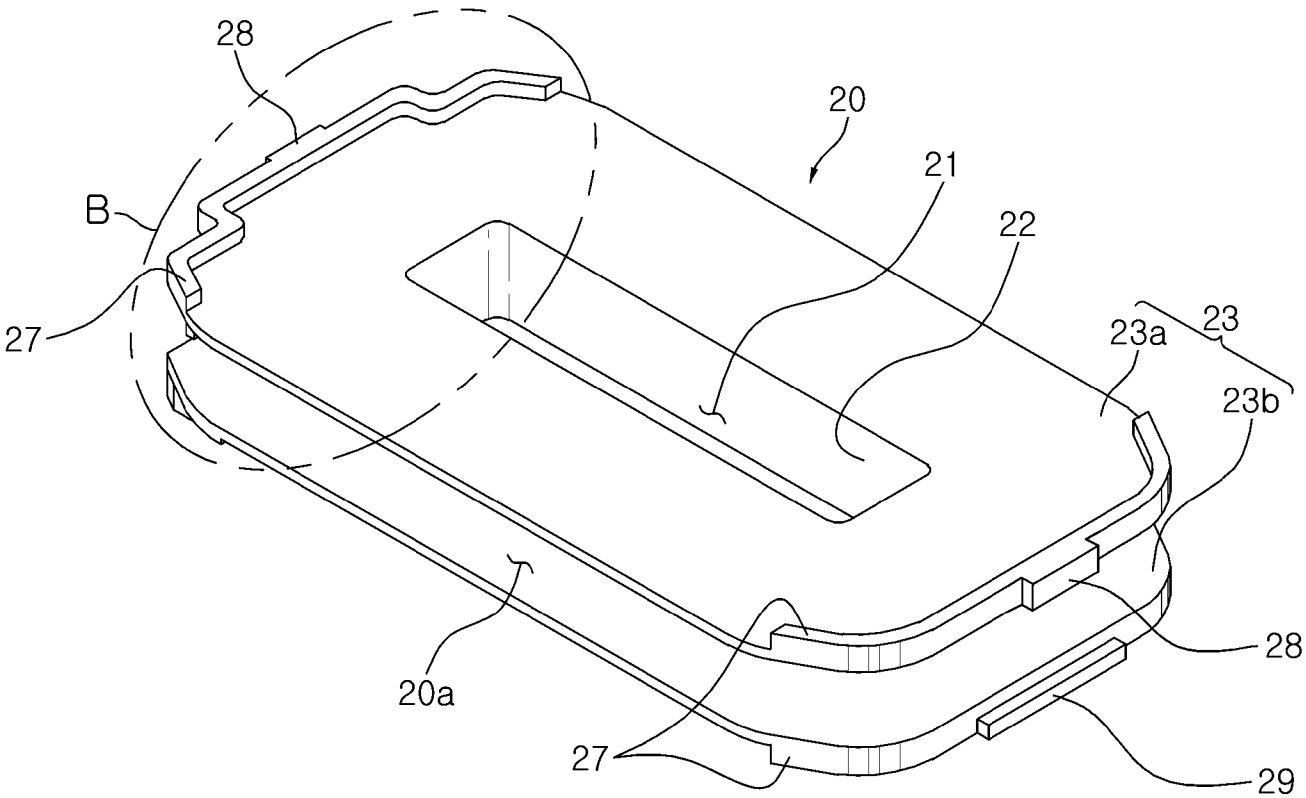
FIG. 4 is a perspective view schematically showing an inner bobbin of the transformer shown in FIG. 1A.
Figure 5:
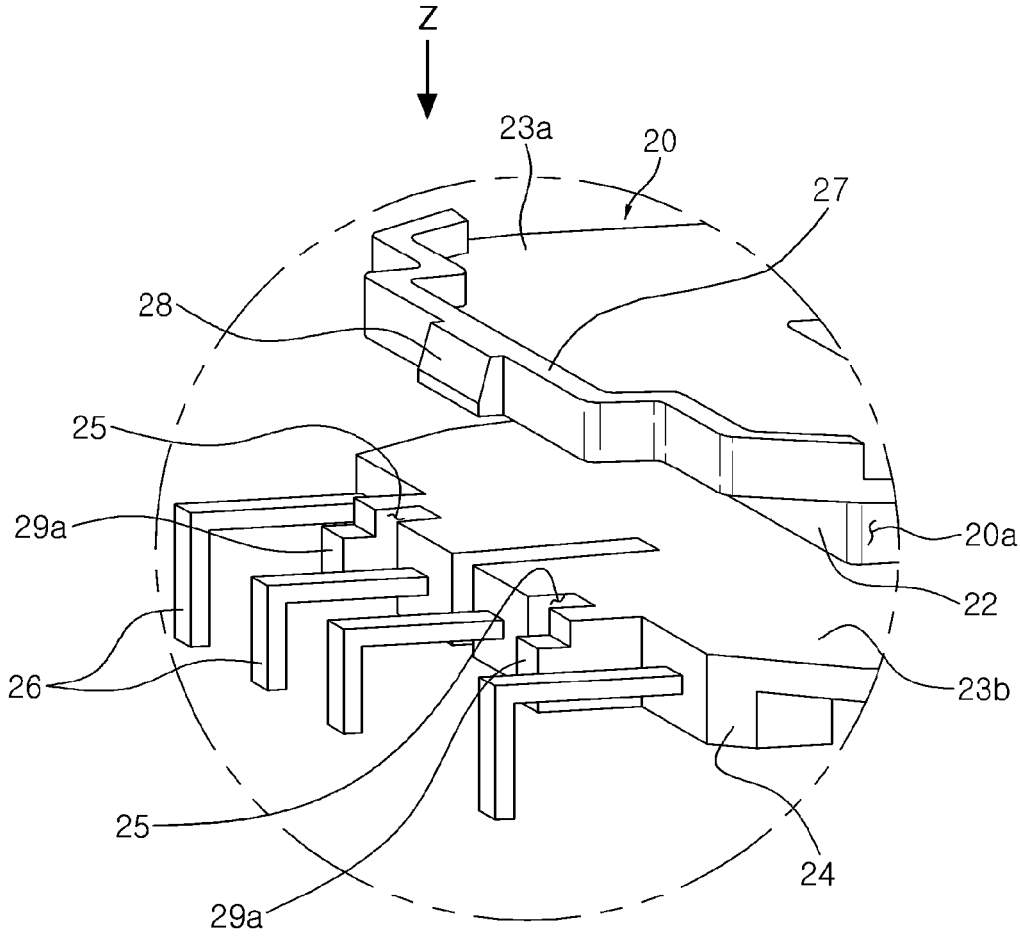
FIG. 5 is a partially enlarged perspective view showing part B of FIG. 4 from another angle.
Figure 6:
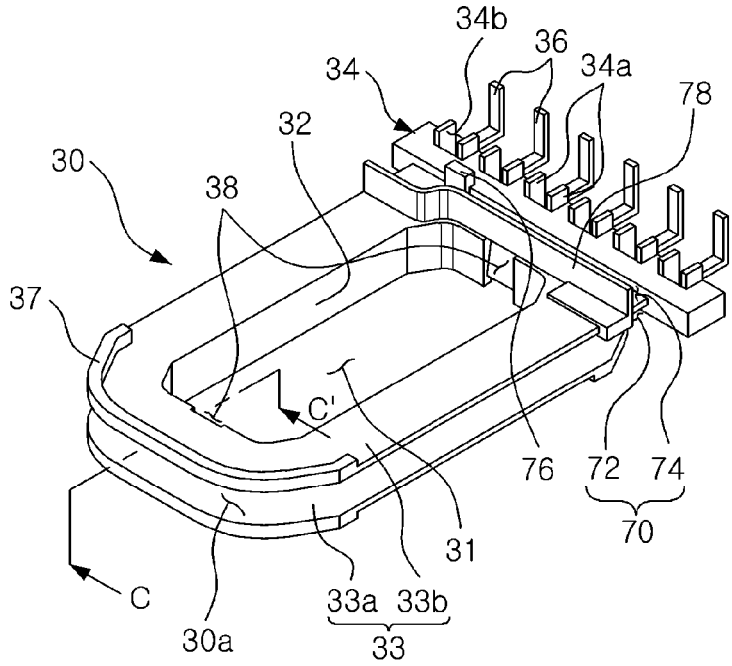
FIG. 6 is a bottom perspective view schematically showing a lower portion of an outer bobbin of the transformer shown in FIG. 1A.
Figure 7:
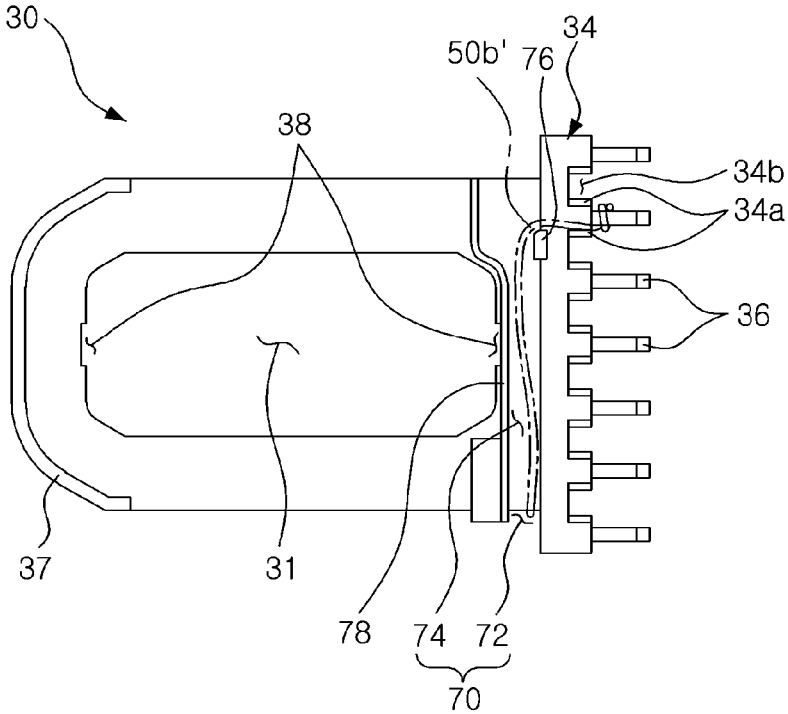
FIG. 7 is a bottom view showing a lower surface of the outer bobbin shown in FIG. 6.
Figure 8:
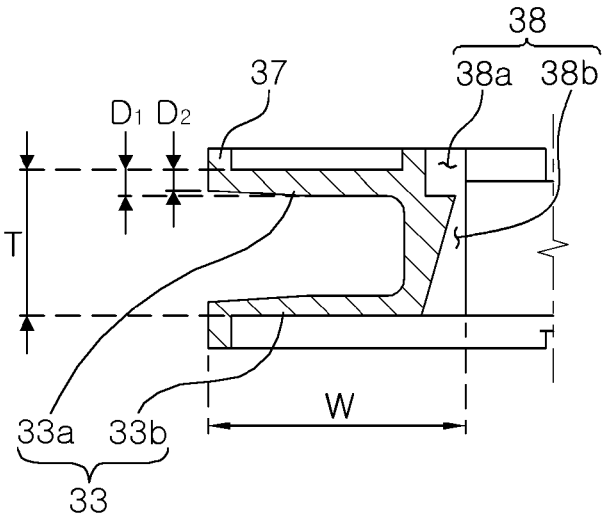
FIG. 8 is a partial cross-sectional view taken along line C-C' of the outer bobbin shown in FIG. 6.

FIG. 4 is a perspective view schematically showing an inner bobbin of the transformer shown in FIG. 1A; and FIG. 5 is a partially enlarged perspective view showing part B of FIG. 4 from another angle. FIG. 6 is a bottom perspective view schematically showing a lower portion of an outer bobbin of the transformer shown in FIG. 1A; FIG. 7 is a bottom view of a lower surface of the outer bobbin shown in FIG. 6; and FIG. 8 is a cross-sectional view taken along line C-C' of the outer bobbin shown in FIG. 6.

Referring to FIGS. 1A through 8, a transformer 100 according to an embodiment of the present invention may include a bobbin part 10, a coil 50, and a core 40.

The bobbin part 10 may include an outer bobbin 30 and at least one inner bobbin 20.

The inner bobbin 20 may include a pipe shaped body part 22 having a through-hole 21 formed at the center of an inner part thereof, a flange part 23 extended from both ends of the body part 22 in an outer diameter direction thereof, external connection terminals 26 for electrical and physical connection to the outside, and a terminal connection part 24 having the external connection terminals 26 connected thereto, as shown in FIGS. 4 and 5.

The through-hole 21 formed in the inner part of the body part 22 may be used as a path into which a portion of the core 40 to be described below is inserted. The present embodiment describes a case in which the through-hole 21 has a rectangular cross section by way of example. The cross sectional shape corresponds to a shape of the core 40 inserted into the through-hole 21. In the inner bobbin 20 according to an embodiment of the present embodiment, the through-hole 21 is not limited to having the above-mentioned shape but may have various shapes corresponding to shapes of the core 40 inserted thereinto.

The flange part 23 may be divided into an upper flange part 23*a* and a lower flange part 23*b* according to a formation position thereof. In addition, a space between an outer peripheral surface of the body part 22 and the upper and lower flange parts 23*a* and 23*b* may be used as an inner winding part 20*a* around which a coil 50 to be described below is wound. Therefore, the flange part 23 serves to protect the coil 50 from the outside and secure insulation therebetween, simultaneously with supporting the coil 50 wound around the inner winding part 20*a* at both sides thereof.

The lower flange part 23*b* of the inner bobbin 20 may include the terminal connection part 24 formed on one side thereof, wherein the terminal connection part 24 includes the external connection terminals 26 connected thereto. The terminal connection part 24 protrudes outwardly (that is, downwardly) from one side of the lower flange part 23*b*, and may include at least one lead groove 25 into which a lead wire of the coil 50 wound around the inner winding part 20*a* is inserted. The lead wire of the coil 50 may be lead to the outside of the inner bobbin 20 by the lead groove 25.

The external connection terminals 26 may be provided to protrude from the terminal connection part 24 in a downward direction or an outer diameter direction of the body part 22 while being connected to the terminal connection part 24. Particularly, the external connection terminals 26 according to the present embodiment may be disposed along an outer peripheral edge of the lower flange part 23*b* and may be connected to the terminal connection part 24.

In addition, the terminal connection part 24 of the inner bobbin 20 may include support parts 29*a* protruding along the outer diameter direction of the body part 22. The support parts 29*a* may be formed in spaces between the external connection terminals 26 disposed to be spaced apart from each other by predetermined intervals, and support the outer bobbin 30 while contacting a lower surface of the outer bobbin 30, similar to a support jaw 29 to be described below.

Meanwhile, the present embodiment describes a case in which the support parts 29*a* protrude in a direction parallel with a direction in which the external connection terminals 26 protrude by way of example. However, the support parts 29*a* according to the present embodiment are not limited thereto but may be formed to have various forms. For example, the support parts 29*a* may protrude from a side of the terminal connection part 24 in a direction perpendicular to a direction in which the external connection terminals 26 protrude.

In addition, the upper flange part 23*a* of the inner bobbin 20 according to the present embodiment may have an outer peripheral edge of one side thereof different to that of the other side thereof. That is, the upper flange part 23*a* may be formed so that the outer peripheral edge disposed at one side thereof, which is an upper portion of the terminal connection part 24, is not formed in an arc shape or a straight line shape, but is bent.

Here, the bending may be formed to correspond to positions of the external connection terminals 26 connected to the terminal connection part 24. That is, when viewed in a Z direction of FIG. 5, the bending may be formed so that the external connection terminals 26 connected to the terminal connection part 24 may be maximally exposed.

The bending of the upper flange part 23*a* is to allow for automatica winding of the coil 50 around the inner bobbin 20. More specifically, the bending may be formed in order to prevent the coil 50 or an automatic winding device (not shown) from contacting the upper flange part 23*a* during a process in which the automatic winding device winds the coil 50 while rotating the coil 50 around a circumference of the external connection terminal 26 in order to wind the coil 50 around the external connection terminal 26.

Therefore, when the coil 50 or the automatic winding device does not contact the upper flange part 23*a* during an automatic winding process, the bending formed in the upper flange part 23*a* may be omitted.

Meanwhile, in order to form a thin transformer 100, the flange part 23 included in the inner bobbin 20 may have a maximally reduced thickness. However, the inner bobbin 20 according to the present embodiment may be formed of a resin material, which is an insulating material. Therefore, when the flange part 23 has an excessively reduced thickness, it does not maintain its shape, such that it may be bent.

Therefore, the transformer 100 according to the present embodiment may include an insulating rib 27 formed on an outer surface of the flange part 23 in order to prevent the flange part 23 from being bent and to reinforce the flange part 23. The insulating rib 27 may be formed in plural in a form in which it protrudes from the outer surface of the flange part 23. In addition, the insulating rib 27 may be formed on both of outer surfaces of the two flange parts 23*a* and 23*b* included in the inner bobbin 20 or be selectively formed on any one thereof as needed.

In addition, since the transformer 100 according to the present embodiment has a reduced thickness as described above, the insulating rib 27 may not protrude excessively from the flange part 23. Therefore, the insulating rib 27 according to the present embodiment may protrude outwardly (that is, upwardly or downwardly) along an outer peripheral surface of the flange part 23 and at a thickness similar to that of the flange part 23.

Due to the shape of the insulating rib 27 as described above, the transformer 100 according to the present embodiment may secure the strength of the flange part 23 while minimizing a protrusion distance of the insulating rib 27.

However, the present invention is not limited thereto but may be variously applied. For example, the protrusion distance of the insulating rib 27 may be set to correspond to a creepage distance, similar to an insulating rib 37 of an outer bobbin 30 to be described below.

In addition, although the accompanying drawings show a case in which the inner bobbin 20 includes only a single insulating rib 27 formed along the outer peripheral edge of the flange part 23 thereof, an insulating rib 27 may be additionally formed in order to further secure the strength of the flange part 23 or secure the creepage distance. In this case, the additionally formed insulating rib 27 may have a ring shape and protrude from an inner part of the flange part 23 along a shape of the flange part 23.

Meanwhile, when the inner bobbin 20 is formed of a material having high strength and the flange part 23 thus maintains its shape without being bent even though the insulating rib 27 is not formed in the inner bobbin 20, the insulating rib 27 of the inner bobbin 20 may be omitted.

In addition, as shown in FIG. 4, the insulating rib 27 according to the present embodiment may be formed only at a portion at which the inner bobbin 20 does not face an inner surface of a core 40 to be described below. That is, the insulating rib 27 according to the present embodiment may be formed only on an outer peripheral surface of the flange part 23 exposed to the outside of the core 40 at the time of the coupling of the core 40 to the bobbin part 10. This is to increase adhesion between the bobbin part 10 and the core 40. However, the present invention is not limited thereto. For example, the insulating rib 27 may be formed over the flange part 23 as needed. In addition, various applications may be made. For example, the insulating rib 27 may protrude more on the flange part 23 exposed to the outside of the core 40 or may protrude less on the flange part 23 facing the inner surface of the core 40.

The flange part 23 of the inner bobbin 20 according to the present embodiment may be coupled to an outer bobbin 30 to be described below. To this end, the flange part 23 may include at least one fitting protrusion 28 and a support jaw 29 formed on the outer peripheral edge thereof.

A pair of fitting protrusions 28 may protrude from the outer peripheral edge of the upper flange part 23*a* in opposite directions. The present embodiment describes a case in which the fitting protrusions 28 respectively protrude from both ends of the outer peripheral edges of the upper flange part 23*a* maximally spaced apart from each other in an outer diameter direction by way of example. However, the present invention is not limited thereto.

In addition, the fitting protrusions 28 according to the present embodiment are not limited to a configuration in which they are formed as a pair, but may be variously configured. For example, a plurality of fitting protrusions 28 may be disposed on the outer peripheral edges of the flange part 23 in several directions.

Further, the present embodiment describes a case in which the fitting protrusions 28 protrude from a side formed by the flange part 23 and the insulating rib 27 by way of example. However, the present invention is not limited thereto but may be variously applied. For example, the fitting protrusions 28 may protrude only from the side of the flange part 23 or only from the side of the insulating rib 27.

The support jaw 29 may be formed on the lower flange part 23*b* and formed at a position corresponding to the position at which the fitting protrusion 28 is formed on the other side of the lower flange part 23*b*, which is an opposite side to the terminal connection part 24. More specifically, the support jaw 29 may protrude from the insulating rib 27 formed on the lower flange part 23*b* in an outer direction direction.

This support jaw 29 may support a lower surface of the outer bobbin 30 when the inner bobbin 20 is coupled to the outer bobbin 30, similar to the support part 29*a* of the terminal connection part 24 described above.

As described above, the fitting protrusion 28 and the support jaw 29 may be formed on the upper flange part 23*a* and the lower flange part 23*b*, respectively, such that when the inner bobbin 20 is coupled to an outer bobbin 30 to be described below, it is not easily separated therefrom. A detailed description thereof will be provided in a description of an outer bobbin 30 below.

The outer bobbin 30 may have a similar shape to that of the inner bobbin 20 and have approximately the same thickness as that of the inner bobbin 20; however, it has a different size therefrom, as shown in FIGS. 6 through 8.

The outer bobbin 30 may include a pipe shaped body part 32 having a through-hole 31 formed at the center of an inner part thereof, a flange part 33, a terminal connection part 34, and external connection terminals 36, similar to the inner bobbin 20. Therefore, a detailed description of the same configurations of the outer bobbin 30 as those of the inner bobbin 20 will be omitted and only a detailed description of different configurations of the outer bobbin 30 therefrom will be provided.

The through-hole 31 formed in the inner part of the body part 32 may be used as a space into which the inner bobbin 20 may be inserted. Therefore, the through-hole 31 formed in the outer bobbin 30 has a shape corresponding to that of an outer peripheral edge of the flange part 23 of the inner bobbin 20.

In addition, a space formed between an outer peripheral surface of the body part 32 of the outer bobbin 30 and the two flange parts 33 may be used as an outer winding part 30*a* around which a coil 50 to be described below is wound.

Similarly to the inner bobbin 20, the outer bobbin 30 may include the terminal connection part 34 formed at a lower flange part 33*b* thereof, wherein the terminal connection part 34 includes the external connection terminals 36 connected thereto.

The external connection terminals 36 may be connected to the terminal connection part 34 so that they protrude from a distal end of the terminal connection part 34 in a downward direction or in an outer diameter direction of the body part 32.

The terminal connection part 34 has a shape in which it protrudes outwardly from one end of the lower flange part 33*b*. More specifically, the terminal connection part 34 according to the present embodiment has a long bar shape in which it protrudes while being extended from the lower flange part 33*b* in an outer diameter direction and a downward direction. Here, respective both distal ends of the terminal connection part 34 having the bar shape further protrude outwardly from an outer peripheral edge of the lower flange part 33*b*.

In addition, a step may be formed at a position at which the terminal connection part 34 and the lower flange part 33*b* are connected to each other. That is, as shown in FIGS. 6 and 7, a lower surface of the terminal connection part 34 protrudes from a lower surface of the lower flange part 33*b* while forming the step.

The terminal connection part 34 according to the present embodiment may include a plurality of external connection terminals 36 disposed to be spaced apart from each other by predetermined intervals. The external connection terminal 36 may be connected to the terminal connection part 34 in a form in which it protrudes from a distal end of the terminal connection part 34 in the downward direction or the outer diameter direction of the body part 32.

In addition, the terminal connection part 34 may include a plurality of guide protrusions 34*a* and lead grooves 34*b* formed thereon, wherein the guide protrusions 34*a* and the lead grooves guide lead wires of the coil 50 to the external connection terminals 36.

A plurality of guide protrusions 34*a* protrude downwardly from a lower surface of the terminal connection part 34 in parallel with each other. The guide protrusion 34*a* is to guide a lead wire of the coil 50 wound around the outer winding part 30*a* so that the lead wire may be easily connected to the external connection terminal 36, as shown in FIG. 1B. Therefore, the guide protrusion 34*a* may protrude beyond a diameter of the lead wire of the coil 50 so as to firmly guide the coil 50.

The lead groove 34*b* may be formed in plural in spaces between the guide protrusions 34*a*, and may be used as a route through which the lead wire of the coil 50 wound around the outer winding part 30*a* moves to the lower surface of the terminal connection part 34.

Due to the configuration of the terminal connection part 34 as described above, the lead wire of the coil 50 wound around the outer winding part 30*a* may move to a lower portion of the outer bobbin 30 while passing through the lead groove 34*b* and is then electrically connected to the external connection terminals 36 through the spaces between the guide protrusions 34*a* disposed adjacent to each other, as shown in FIGS. 1A and 1B. Here, the lead wire 50*b*' of the coil 50 may be wound around the guide protrusion 34*a* one time or several times and then connected to the external connection terminal 36 so that it may be more firmly fixed thereto.

Although the present embodiment describes a case in which the guide protrusion 34*a* is only formed on the terminal connection part 34 of the outer bobbin 30, the present invention is not limited but may be variously applied as needed. For example, the guide protrusion 34*a* may also be formed on the terminal connection part 24 of the inner bobbin 20.

Meanwhile, in the transformer 100 according to the present embodiment, a coil skip part 70 to be described below may be used together with the lead groove 25 in order to guide a lead wire 50*b*' of a secondary coil 50*b* to the external connection terminal 36.

As shown in FIGS. 6 and 7, the transformer 100 according to the present embodiment may include the coil skip part 70.

The coil skip part 70 provides a route through which the lead wire 50*b*' of the secondary coil 50*b* wound around the outer bobbin 30 is skipped to an outer surface (that is, the lower surface) of the lower flange part 33*b* through the outer peripheral edge of the outer bobbin 30 rather than the terminal connection part 34 and is then connected to the external connection terminal 26.

The coil skip part 70 according to the present embodiment may be formed by a guide block 78, the terminal connection part 34 and a support protrusion 76, and may include a skip groove 72 and a traversing route 74.

The guide block 78 may be formed on a lower surface of the outer bobbin 30, that is, the lower surface of the lower flange part 33*b*. The guide block 78 is included in order to provide a path through which the lead wire 50*b*' of the secondary coil 50*b* is disposed on the lower surface of the outer bobbin 30, simultaneously with securing a creepage distance between the external connection terminals 36 of the outer bobbin 30 and a primary coil 50*a* of the inner bobbin 20.

To this end, the guide block 78 according to the present embodiment may protrude from a space between the terminal connection part 34 and the through-hole 31 and may be disposed to traverse the lower surface of the lower flange part 33*b* of the outer bobbin 30 in a direction that is parallel to the terminal connection part 34.

In addition, at least one of both distal ends of the guide block 78 according to the present embodiment may protrude outside from the lower flange part 33*b* of the outer bobbin 30. Here, a space between one end of the outwardly protruding guide block 78 and one end of the terminal connection part 34 may be used as the skip groove 72.

The skip groove 72 may be a groove formed by one end of the guide block 78 vertically protruding outwardly from the outer peripheral edge of the lower flange part 33*b*, one end of the terminal connection part 34, and the lower flange part 33*b* provided therebetween, as described above. The skip groove 72 may be used as a route through which the lead wire 50*b*' of the secondary coil 50*b* wound around the outer bobbin 30 is skipped to the lower portion of the outer bobbin 30.

The skip groove 72 according to the present embodiment may be formed by forming the lower flange part 33*b* provided between one end of the guide block 78 and one end of the terminal connection part 34 to have a concave groove shape in order to increase a size (or a depth) thereof.

Meanwhile, the present embodiment describes a case in which the guide block 78 and one end of the terminal connection part 34 protrude outwardly of the lower flange part 33*b* to thereby form the skip groove 72 by way of example. However, the present invention is not limited thereto but may be variously changed. For example, grooves having various shapes may be used as long as they are formed on the outer peripheral edge of the lower flange part 33*b*, such as a case in which a groove is formed through removal of a portion of the lower flange part 33*b* between the guide block 78 and the terminal connection part 34 rather than the protrusion of the guide block 78 and one end of the terminal connection part 34, or the like.

In addition, the guide block 78 according to the present embodiment may be formed so that a spaced distance between the other end thereof and the terminal connection part 34 is larger than a spaced distance of one end thereof and the terminal connection part 34. This is to automatically connect the lead wire 50*b*' of the secondary coil 50*b* to the external connection terminal 36, which will be described below.

The traversing route 74, which is a path formed between the guide block 78 and the terminal connection part 34, provides a path traversing the lower flange part 33*b*. The traversing route 74 may be used as a route through which the lead wire 50*b*' of the secondary coil 50*b* skipped through the skip groove 72 is disposed in a length direction of the terminal connection part 34.

The support protrusion 76 may be provided in order to change a route of the lead wire 50' disposed in the traversing route 74. That is, the support protrusion 76 according to the present embodiment may be provided in order to change a disposition route of the lead wires 50*b*' so that the lead wires 50*b*' disposed in the traversing route 74 may be connected to corresponding external connection terminals 36, respectively. Therefore, the lead wire 50*b*' has a route changed from the traversing route 74 toward a direction in which the external connection terminals 36 are disposed while supporting the support protrusion 76.

The support protrusion 76 according to the present embodiment may protrude perpendicularly to a plane formed by the flange part 33. The support protrusion 76 may protrude outwardly from the traversing route 74 or the terminal connection part 34. The present embodiment describes a case in which the support protrusion 76 protrudes from a portion at which the lower flange part 33*b* and the terminal connection part 34 are connected to each other downwardly of the lower flange part 33*b* in a protrusion shape by way of example. However, the present invention is not limited thereto.

A plurality of support protrusions 76 corresponding to the number of lead wires 50*b*' disposed in the traversing route 74 or the number of external connection terminals 36 having the corresponding lead wires 50*b*' connected thereto may be formed.

In addition, the support protrusion 76 according to the present embodiment may protrude so that an outer surface thereof contacting the lead wire 50*b*' is approximately perpendicular to a bottom surface thereof (that is, the lower flange part of the outer bobbin). This configuration of the support protrusion 76 is to prevent the lead wire 50*b*' supported by the support protrusion 76 from being separated from the support protrusion 76.

Therefore, the support protrusion 76 according to the present embodiment is not limited to having the above-mentioned configuration but may have various shapes as long as the lead wire 50*b*' supported by the support protrusion 76 is not separated from the support protrusion 76. For example, a contact surface of the support protrusion 76 contacting the lead wire 50*b*' may form an acute angle with respect to the above-mentioned bottom surface. In addition, various applications may be provided. For example, a step or a groove may be formed in the contact surface of the support protrusion 76.

In addition, the contact surface of the support protrusion 76 contacting the lead wire 50*b*' may include a chamfer formed in order to minimize friction between the support protrusion 76 and the lead wire 50*b*', wherein the chamfer has a curved surface or an inclined surface.

In addition, when the transformer 100 according to the present embodiment includes a plurality of support protrusions 76, the respective support protrusions 76 may have different sizes.

More specifically, one sides of the plurality of support protrusions 76 according to the present embodiment contacting the traversing route 74 may partially protrude into the traversing route 74. Here, protrusion distances may be different for each of the support protrusions 76.

In this case, one ends of the support protrusions 76 may have the protrusion distances that become smaller as the support protrusions 76 are disposed to be adjacent to the skip groove 72 and that become larger as they are disposed to be far from the skip groove 72. This configuration of the support protrusions 76 is to prevent a defect in which, when the number of the lead wires 50*b*' of the coil 50*b* skipped through the skip groove 72 is plural, the skipped lead wires 50*b*' are disposed in a state in which they are tangled or twisted, such that a short circuit occurs between the lead wires 50*b*', or the like.

That is, in the transformer 100 according to the present embodiment, the lead wires 50*b*' supporting the respective support protrusions 76 may be disposed at different positions according to the protrusion distances of the support protrusions 76. Therefore, even though the plurality of lead wires 50*b*' are skipped through the skip groove 72, the respective lead wires 50*b*' may be disposed in parallel with each other without being overlapped within the traversing route 74 to thereby prevent the above-mentioned defect from occurring.

Meanwhile, as shown in FIG. 7, the present embodiment describes a case in which the route of the lead wire 50*b*' moves through an approximate right angle while passing through the support protrusions 76 by way of example. However, the present invention is not limited thereto. For example, a route of the lead wire 50*b*' may be set at various angles as long as the lead wire 50*b*' may be firmly fixedly connected to the external connection terminal 36 without causing interference with other lead wires 50*b*'.

Hereinafter, a process of winding the secondary coil 50*b* around the outer bobbin 30 according to the present embodiment described above and then connecting the lead wire 50*b*' to the external connection terminal 36 using the coil skip part 70 will be described.

The secondary coil 50*b* wound around the outer wiring part 30*a* of the outer bobbin 30 may move to the lower surface of the outer bobbin 30 so that the lead wire 50*b*' is connected to the external connection terminal 36 while being wound therearound. Here, the lead wire 50*b*' of the secondary coil 50*b* may move to the lower surface of the outer bobbin 30 through the lead groove 34*b* or the skip groove 72 of the coil skip part 70 described above.

The lead wire 50*b*' moved to the lower surface of the outer bobbin 30 through the lead groove 34*b* may be directly connected to the external connection terminal 36 through a space between the guide protrusions 34*a*. Here, in order to firmly fix the lead wire 50*b*', various methods may be used. For example, the transformer 100 according to the present embodiment may be configured so that the lead wire 50*b*' is wound around the guide protrusion 34*a* once or several times and is then connected to the external connection terminals 36.

On the other hand, when the lead wire 50*b*' is connected to the external connection terminal 36 through the coil skip part 70, it may move to the lower surface of the outer bobbin 30 through the skip groove 72. Then, the lead wire 50*b*' may be disposed in the traversing route 74 formed on the lower surface of the outer bobbin 30 and then may have a changed route while supporting the support protrusion 76. Thereafter, the lead wire 50*b*' may be wound around the external connection terminal 36, such that it is physically and electrically connected to the external connection terminal 36, whereby completing the winding.

In the transformer 100 according to the present embodiment described above, the coil skip part 70 may be configured so that the secondary coil 50*b* may be automatically wound around the outer bobbin 30.

That is, in the transformer 100 according to the present embodiment, a process of winding the secondary coil 50*b* around the outer bobbin 30, a process of disposing the lead wire 50*b*' in the traversing route 74 while skipping the lead wire 50*b*' of the secondary coil 50*b* to the lower surface of the outer bobbin 30 through the skip groove 72, and processes of changing the route of the lead wire 50*b*' while supporting the support protrusion 76 to thereby lead the lead wire 50*b*' toward a direction in which the external connection terminal 36 is formed and then connecting the lead wire 50*b*' to the external connection terminal 36, may be automatically performed through a separate automatic wiring device (not shown).

Here, as described above, the guide block 78 according to the present embodiment may be formed so that a spaced distance between the other end thereof and the terminal connection part 34 is larger than a spaced distance of one end thereof and the terminal connection part 34. Due this configuration, the automatic winding device may easily wind the lead wire 50*b*' around the support protrusion 76 using the increased space (that is, the traversing route). Therefore, a process of changing the route of the lead wire 50*b*' may be easily performed automatically.

The transformer 100 according to the present embodiment may include the coil skip part 70, which is a route through which the lead wire 50*b*' of the secondary coil 50*b* traverses the outer bobbin 30 from the lower surface of the outer bobbin 30.

Therefore, the lead wires 50*b*' of the secondary coil 50*b* may be connected to the external connection terminals 36 while being disposed in a distributed scheme on one surface (that is, the lead groove of the terminal connection part) and the other surface (that is, the coil skip part) of the lower flange part 33*b* in order to prevent an intersection therebetween, whereby the lead wires 50*b*' of the coil 50*b* may be connected to the external connection terminals 36 through various routes, as compared to the transformer according to the related art.

According to the related art, when the plurality of coils are wound around the bobbin, the lead wires of the coil leaded to the external connection terminals are disposed to intersect with each other. Therefore, the lead wires contact each other, thereby causing a short circuit between the coils.

However, the transformer 100 according to the present embodiment provides a new route by the coil skip part 70 as described above, whereby the lead wires 50*b*' may be connected to the external connection terminals 36 through various routes. Therefore, the intersection or the contact between the lead wires 50*b*' may be prevented.

Further, the flange part 33 of the outer bobbin 30 according to the present embodiment may have a maximally reduced thickness, similar to the case of the inner bobbin 20.

Therefore, at least one insulating rib 37 may be provided on the flange part 33 in order to prevent the flange part 33 from being bent and secure the strength of the flange part 33.

Here, the insulating rib 37 formed on the outer bobbin 30 may be formed in plural in a form in which it protrudes from the outer surface of the flange part 33, similar to the case of the inner bobbin 20. In addition, the insulating rib 37 may protrude by a distance through which a creepage distance may be secured between the coil 50 wound around the outer bobbin 30 and the coil 50 wound around the inner bobbin 20 while the strength of the flange part 33 is maintained.

A detailed description thereof will be provided below.

As shown in FIG. 3, when the inner bobbin 20 and the outer bobbin 30 are coupled to each other, a creepage distance between a primary coil 50*a* wound around the inner bobbin 20 and a secondary coil 50*b* wound around the outer bobbin 30 may be mainly formed along an outer surface of the flange part 33 of the outer bobbin 30.

Therefore, in the transformer 100 according to the present embodiment, the insulating rib 37 may be used in order to secure a creepage distance while minimizing a size of the outer bobbin 30. That is, the number and the protrusion distance of insulating ribs 37 are controlled, thereby securing the creepage distance between the coil 50 wound around the inner bobbin 20 and the coil 50 wound around the outer bobbin 30.

Here, in the case in which the flange part 23 of the inner bobbin 20 is extended to be sufficiently long, an empty space S having a predetermined interval may be formed between an outer surface of the primary coil 50*a* wound around the inner bobbin 20 and an inner peripheral surface of the through-hole 31 of the outer bobbin 30. Therefore, in this case, a distance between the primary coil 50*a* and the secondary coil 50*b* may be further secured. As a result, even though only a single insulating rib 37 is provided, the creepage distance may be easily secured. This may be equally applied to a case in which the flange part 33 of the outer bobbin 30 is extended to be sufficiently long.

On the other hand, in the case in which the flange part 23 or 33 of the inner or outer bobbin 20 or 30 has a relatively short length to thereby have a difficulty in securing the creepage distance only with a width of the flange part 23 or 33, the transformer 100 according to the present embodiment includes an insulating rib 37 additionally formed on the flange part 33 of the outer bobbin 30, whereby the creepage distance may be secured.

Here, a plurality of insulating ribs 37 formed on the outer bobbin 30 may be configured to have different protrusion distances in order to secure the creepage distance.

Meanwhile, similar to the case of the inner bobbin 20, the insulating rib 37 formed on the outer bobbin 30 may be formed on both of outer surfaces of the two flange parts 33*a* and 33*b* included in the outer bobbin 30 or selectively formed on any one thereof as needed. In addition, the insulating rib 37 may be formed along an outer peripheral edge of the flange part 33 or be formed to protrude in a ring shape from an inner part of the flange part 33 along a shape of the flange part 33.

Furthermore, the insulating rib 37 of the outer bobbin 30 may be formed only at a portion at which the outer bobbin 30 does not face the inner surface of the core 40, and may be omitted in the case in which the flange part 33 maintains its shape without being bent, even in the case that the insulating rib 37 is not formed, similar to the insulating rib 27 of the inner bobbin 20.

The outer bobbin 30 according to the present embodiment may include at least one coupling groove 38 formed in an inner peripheral surface of the body part 32 so that the inner bobbin 20 inserted into the through-hole 31 may be fixed thereto.

The coupling groove 38 may be formed to correspond to the number, the position, and the shape of the fitting protrusions 28 formed on the inner bobbin 20.

In the case of the present embodiment, a pair of fitting protrusions 28 may protrude from the outer peripheral edge of the upper flange part 23*a* of the inner bobbin 20 in opposite directions. Correspondingly, a pair of coupling grooves 38 may be formed opposite to each other in positions on an inner peripheral surface of the through-hole 31 of the outer bobbin 30.

The coupling groove 38 may include a fitting groove 38*a* and a guide groove 38*b*, as shown in FIG. 8.

The fitting groove 38*a* may be formed as a groove having a shape corresponding to that of the fitting protrusion 28 at one end, that is, an upper end, of the body part 32. The fitting groove 38*a* may be a groove into which the fitting protrusion 28 of the inner bobbin 20 is fitted. The fitting protrusions 28 may be fitted into the fitting grooves 38*a* of the coupling groove 38, whereby the inner and outer bobbins 20 and 30 are finally coupled to each other. Therefore, when the fitting protrusion 28 is inserted into the fitting groove 38*a*, the inner bobbin 20 is completely inserted into the through-hole 31 of the outer bobbin 30, such that the inner bobbin 20 and the outer bobbin 30 are integral with each other.

The guide groove 38*b* may be formed in a groove shape in which it traverses the inner peripheral surface of the body part 32 of the outer bobbin 30 from the fitting groove toward the other end, that is, a lower end, of the body part 32 of the outer bobbin 30 and has an inclined bottom surface. That is, the guide groove 38*b* has a maximum depth at the other end portion of the body part 32 and a minimal depth at a position adjacent to the fitting groove 38*a*. The guide groove 38*b* may be used as a path through which the fitting protrusion 28 moves when the inner bobbin 20 is coupled to the outer bobbin 30.

A process of coupling the fitting protrusion 28 and the coupling groove 38 described above to each other will now be described.

In order to couple the inner bobbin 20 to the outer bobbin 30, a process of inserting the other side of the inner bobbin 20 at which the support jaw 29 is formed into the through-hole 31 of the outer bobbin 30 is first performed. Here, the other side of the inner bobbin 20 may be inserted from a lower portion of the outer bobbin 30 into the through-hole 31 thereof. In addition, the fitting protrusion 28 of the inner bobbin 20 may be coupled to the coupling groove 38 at one side of the outer bobbin 30 at which the terminal connection part 34 is formed while being slightly inserted thereinto.

Then, a process of pushing one side of the inner bobbin 20 at which the terminal connection part 24 is formed into the through-hole 31 of the outer bobbin 30 is performed. In this process, the fitting protrusion 28 at the side at which the terminal connection part 24 is formed enters the guide groove 38*b* of the coupling groove 38 formed at the other side of the outer bobbin 30.

As described above, since the guide groove 38*b* has a deepest depth in the vicinity of a lower end surface of the body part 32, the fitting protrusion 28 may be easily inserted into the guide groove 38*b* of the coupling groove 38.

The inner bobbin 20 may be pushed into the through-hole 31 of the outer bobbin 30, whereby the fitting protrusion 28 inserted into the guide groove 38*b* moves upwardly of the body part 22 of the outer bobbin 30 along the guide groove 38*b* to be thereby finally inserted into the fitting groove 38*a*. Here, the support part 29*a* formed in the terminal connection part 24 of the inner bobbin 20 and the support jaw 29 suppress the inner bobbin 20 from moving excessively upward of the outer bobbin 30 while contacting the lower surface of the outer bobbin 30.

The fitting protrusion 28 may be inserted into the fitting groove 38*a* of the coupling groove 38, such that the inner bobbin 20 is caught by a step dividing the guide groove 38*b* and the fitting groove 38*a*. Therefore, downward movement of the inner bobbin 20 may be suppressed. In addition, the support jaw 29 and the support part 29*a* of the terminal connection part 24 support the lower end surface of the outer bobbin 30, such that upward movement of the inner bobbin 20 is suppressed. Therefore, after the coupling between the inner and outer bobbins 20 and 30 is completed, the inner bobbin 20 may not be easily separated from the outer bobbin 30.

Meanwhile, in the transformer 100 according to the present embodiment, in the case of the coupling groove 38 of the outer bobbin 30 into which the fitting protrusion 28 is first fitted, the fitting protrusion 28 is directly inserted into the fitting groove 38*a*. Therefore, the coupling groove 38 into which the fitting protrusion 28 is first fitted needs not to include a separate guide groove for guiding the fitting protrusion 28 to the fitting groove 38*a*. As a result, the coupling groove 38 into which the fitting protrusion 28 is first fitted may include only the fitting groove 38*a*.

Meanwhile, as shown in FIGS. 3 and 8, in the transformer 100 according to the present embodiment, the flange parts 23 and 33 of individual bobbins (the inner and outer bobbins 20 and 30) have a width W larger than a thickness T of the body parts 22 and 32. Here, although FIG. 8 shows only a cross-section of the outer bobbin 30 for convenience of description, the above-mentioned feature may also be applied to the inner bobbin 20.

This shape may be derived from a feature in which the transformer 100 according to the present embodiment has a reduced thickness. That is, the transformer 100 according to the present embodiment may be a thin transformer 100 having a significantly reduced thickness. For example, the transformer 100 including the external connection terminals 26 and 36 may have an entire vertical thickness of about 12 nm or less.

In order to secure an output voltage in the transformer 100 having the reduced thickness as described above (in order to secure the turn number of the coil), the respective winding parts 20*a* and 30*a* having the coils 50 wound therearound need to have a relatively deep depth in the individual bobbins 20 and 30 according to the present embodiment than in the bobbin according to the related art.

To this end, in the individual bobbins 20 and 30 according to the present embodiment, the flange parts 23 and 33 have a width W larger than a thickness T of the body parts 22 and 32.

In addition, in the inner and outer bobbins 20 and 30 according to the present embodiment, the flange parts 23 and 33 may have inclined inner surfaces (that is, surfaces forming the inner winding part and the outer winding part). As a result, the flange parts 23 and 33 may have a thickness that is reduced in an outer diameter direction.

Although FIG. 8 shows only a cross-section of the outer bobbin 30, the above-mentioned feature may also be applied to the inner bobbin 20, as described above. Referring to FIG. 8, the flange parts 23 and 33 have a basic thickness of D1. However, a thickness of the flange parts 23 and 33 may become thinner toward the outer diameter direction, such that the flange parts 23 and 33 have a thickness of D2 at outer peripheral edges thereof. Therefore, the winding parts 20*a* and 30*a* have a width that becomes wider in the outer diameter direction.

These configurations may be derived from the thin transformer 100 according to the present embodiment thin. More specifically, in the transformer 100 according to the present embodiment, the flange parts 23 and 33 have the width W larger than the thickness T of the body parts 22 and 32, such that the respective winding parts 20*a* and 30*a* of the individual bobbins 20 and 30 have a significantly deeper depth than that of the winding parts of the bobbins in the transformer according to the related art. Due to this specific structure, a mold inserted into the winding parts 20*a* and 30*a* during a process of manufacturing the individual bobbins 20 and 30 is not easily separated from the individual bobbins 20 and 30.

However, in the transformer 100 according to the present embodiment, the winding parts 20*a* and 30*a* have the width that increases toward the outer diameter direction, whereby the mold may be easily separated from the individual bobbins 20 and 30.

Meanwhile, the flange parts 23 and 33 according to the present embodiment have a thickness that decreases in the outer diameter direction, such that it may be easily bent. However, as described above, the flange parts 23 and 33 according to the present embodiment may include the insulating ribs 27 and 37 formed on the outer surfaces thereof. Therefore, even in the case that the thickness of the flange parts becomes thin, a defect that the flange parts are easily bent may be solved.

In the bobbin part 10 according to the present embodiment configured as described above, the external connection terminals 26 included in the inner bobbin 20 and the external connection terminals 36 included in the outer bobbin 30 may be disposed to be maximally spaced apart from each other. Therefore, when the inner bobbin 20 is coupled to the outer bobbin 30, it is coupled to the outer bobbin 30 so that a portion at which the terminal connection part 24 is formed is positioned in an opposite direction to a position at which the terminal connection part 34 of the outer bobbin 30 is formed.

Therefore, the external connection terminals 36 of the outer bobbin 30 and the external connection terminals 26 of the inner bobbin 20 may be disposed to protrude in opposite directions. Therefore, in the transformer 100 according to the present embodiment, the external connection terminals 26 of the primary coil 50*a* may be sufficiently spaced apart from the external connection terminals 36 of the secondary coil 50*b*, whereby an insulation distance between the primary and secondary coils may be easily secured.

In addition, as shown in FIG. 3, in the transformer 100 according to the present embodiment, insulation between the primary coil 50*a* wound around the inner winding part 20*a* and the secondary coil 50*b* wound around the outer winding part 30*a* may be secured by the outer bobbin 30. Therefore, the primary and secondary coils 50*a* and 50*b* may be disposed maximally adjacent to each other.

However, in order to secure output characteristics of the transformer 100 or the creepage distance, an outer surface of the primary coil 50*a* may also be spaced apart from the inner peripheral surface of the through-hole 31 of the outer bobbin 30 by a predetermined interval S. This may be easily applied by controlling the width of the flange part 23 of the inner bobbin 20 or the turn number of the primary coil 50*a* wound around the inner bobbin.

Further, in the bobbin part 10 according to the present embodiment, when the inner bobbin 20 and the outer bobbin 30 are coupled to each other, the flange part 23 of the inner bobbin 20 and the flange part 33 of the outer bobbin 30 may be positioned on the same plane. That is, the bobbin part 10 in which the inner bobbin 20 and the outer bobbin 30 are coupled to each other includes partially protruding parts only at the portions at which the insulating ribs 27 or 37 or the terminal connection parts 24 and 34 are formed and has an entirely flat slim shape. Therefore, even though the bobbin part is mounted on a substrate, it may be mounted at a significantly low mounting height, such that it may be easily used in a slim display device, or the like.

Further, although the present embodiment describes a case in which the bobbin part 10 is configured of a single outer bobbin 30 and a single inner bobbin 20 by way of example, the present invention is not limited thereto. A plurality of bobbins may be inserted into the single outer bobbin 30. For example, the bobbin part 10 may be configured so that a separate bobbin (hereinafter, referred to as an intermediate bobbin) having a similar shape to that of the outer bobbin 30 is inserted into the through-hole 31 of the outer bobbin 30 and the inner bobbin 20 is inserted into a through-hole of the intermediate bobbin, and the core 40 may be configured to be inserted into the through-hole 21 of the inner bobbin 20.

In this case, any one of the primary and secondary coils may be selectively wound around two of three individual bobbins.

The individual bobbins 20 and 30 of the bobbin part 10 according to the present embodiment may be easily manufactured by an injection molding method. However, the present invention is not limited thereto. The individual bobbins 20 and 30 may be manufactured by various methods such as a press processing method, or the like. In addition, the individual bobbins 20 and 30 according to the present embodiment may be formed of an insulating resin material and a material having high heat resistance and high voltage resistance. As a material of the individual bobbins 20 and 30, polyphenylenesulfide (PPS), liquid crystal polyester (LCP), polybutyleneterephthalate (PBT), polyethyleneterephthalate (PET), phenolic resin, and the like, may be used.

The coil 50 may include the primary coil 50*a* and the secondary coil 50*b*.

The primary coil 50*a* may be wound around the inner wining part 20*a* formed in the inner bobbin 20.

Further, the primary coil 50*a* according to the present embodiment may include a plurality of coils electrically insulated from each other and wound around a single inner winding part 20*a*. That is, in the transformer 100 according to the present embodiment, the primary coil 50 may be configured of the plurality of coils, such that a voltage may be selectively applied to each of the coils and various voltages may be drawn through the secondary coil 50*b* correspondingly.

To this end, as the plurality of coils configuring the primary coil 50*a*, coils having different diameters and turn numbers may be used. In addition, a single wire or a twisted pair wire formed by twisting several strands may be used.

The lead wire of the primary coil 50*a* may be connected to the external connection terminal 26 included in the inner bobbin 20.

The secondary coil 50*b* may be wound around the outer winding part 30*a* formed in the outer bobbin 30.

Similarly to the above-mentioned primary coil 50*a*, the secondary coil 50*b* may also include a plurality of coils electrically insulated from each other. An example thereof is shown in FIG. 3. The lead wire of the secondary coil 50*b* may be connected to the external connection terminal 36 included in the outer bobbin 30.

Meanwhile, as described above, the present embodiment describes a case in which the primary coil 50*a* is wound around the inner winding part 20*a* and the secondary coil 50*b* is wound around the outer winding part 30*a* by way of example. However, the present invention is not limited thereto but may be variously applied as long as a voltage desired by a user may be drawn. For example, the primary coil 50*a* may be wound around the outer winding part 30*a* and the secondary coil 50*b* may be wound around the inner winding part 20*a*.

The core 40 may be inserted into the through-hole 21 formed in the inner part of the inner bobbin 20 and may be electromagnetically coupled to the coil 50 to thereby form a magnetic path.

The core 40 according to the present embodiment may be configured in a pair. The pair of cores 40 may be respectively inserted into the through-hole 21 of the inner bobbin 20 to thereby be connected to each other while facing each other. As the core 40, an "EE" core, an "EI" core, or the like, may be used.

The core 40 may be formed of Mn—Zn based ferrite having higher permeability, lower loss, higher saturation magnetic flux density, higher stability, and lower production costs, as compared to other materials. However, in an embodiment of the present invention, the shape or the material of the core 40 is not limited.

Meanwhile, although not shown, the bobbin part 10 and the core 40 according to the present embodiment may include an insulating tape interposed therebetween. The insulating tape may be provided in order to secure an insulation property between the coil 50 wound around the bobbin part 10 and the core 40.

The insulating tape may be interposed between the bobbin part 10 and the core 40 to correspond to the entire inner peripheral surface of the core 40 facing the bobbin part 10 or be partially interposed therebetween only at a portion at which the coil 50 and the core 40 face each other.

Meanwhile, the transformer according to the present embodiment is not limited to the above-mentioned embodiment but may be variously applied. A transformer according to an embodiment to be described below has a similar structure to that of the transformer 100 (please see FIG. 1) according to the above-mentioned embodiment and is different therefrom only in a form of a coil skip part included in the outer bobbin. Accordingly, a detailed description of the same components will be omitted, and a coil skip part of an outer bobbin will be mainly described in detail. In addition, like reference numerals denote the same elements as those in an embodiment of the present invention.

Figure 9:
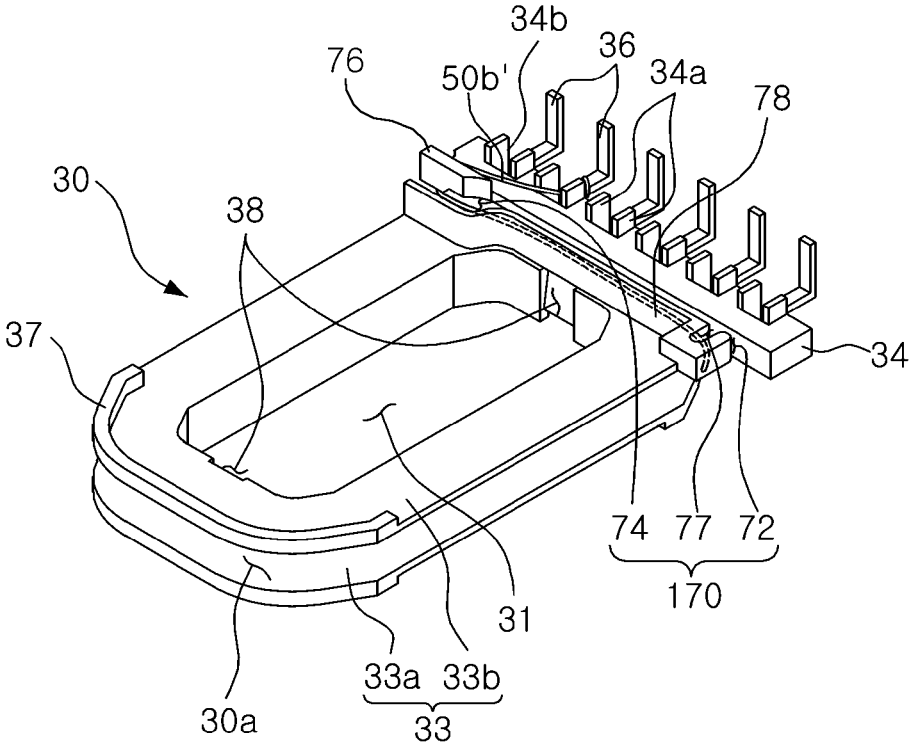
FIG. 9 is a perspective view showing a lower surface of an outer bobbin according to another embodiment of the present invention.
Figure 10:
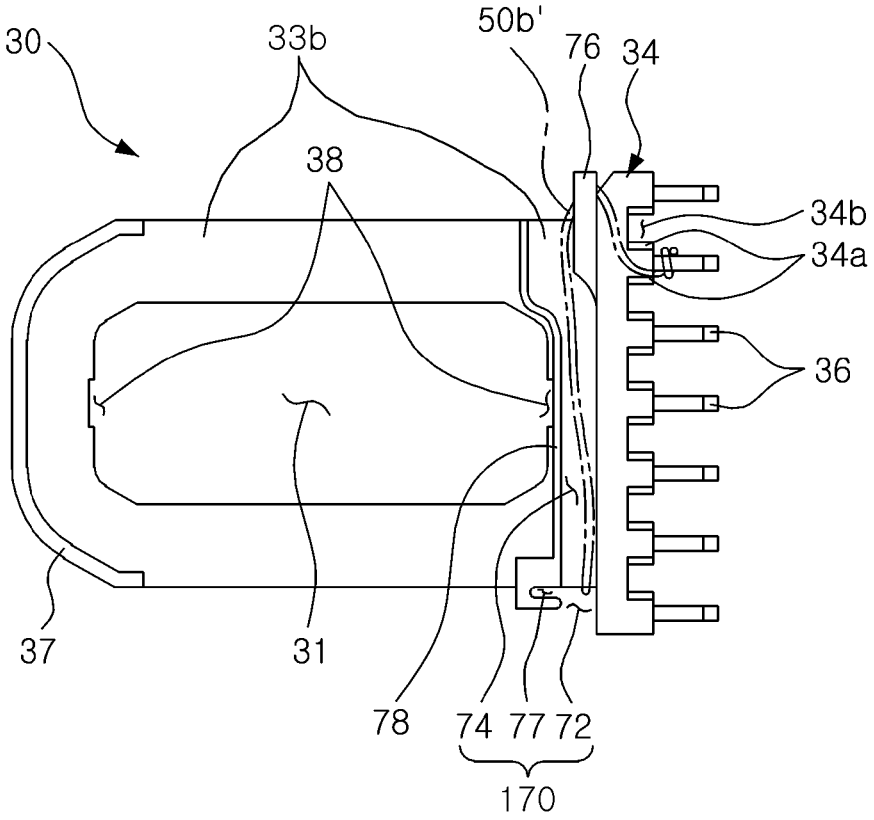
FIG. 10 is a bottom view of a lower surface of the outer bobbin shown in FIG. 9.

FIG. 9 is a perspective view showing a lower surface of an outer bobbin according to another embodiment of the present invention; and FIG. 10 is a bottom view of a lower surface of the outer bobbin shown in FIG. 9.

Referring to FIGS. 9 and 10, an outer bobbin 30 according to the present embodiment may include a coil skip part 170, similar to the above-mentioned embodiment.

The coil skip part 170 according to the present embodiment may be formed by a guide block 78, a support protrusion 76, and the terminal connection part 34, and may include a catching groove 77, a skip groove 72, and a traversing route 74.

Meanwhile, in the present embodiment, the skip groove 72 and the traversing route 74 may have the same configuration as that of the skip groove 72 and the traversing route 74 in the above-mentioned embodiment. A detailed description thereof will be omitted.

The guide block 78 may be formed on a lower surface of the outer bobbin 30, that is, the lower surface of the lower flange part 33*b*, similar to the above-mentioned embodiment. The guide block 78 is included in order to provide a path through which the lead wire 50*b*' of the secondary coil 50*b* wound around the outer bobbin 30 is disposed, simultaneously with securing a creepage distance between the external connection terminals 36 of the outer bobbin 30 and a primary coil 50*a* (please see FIG. 3) of the inner bobbin 20 (please see FIG. 3).

To this end, the guide block 78 according to the present embodiment may protrude from a space between the terminal connection part 34 and the through-hole 31 and may be disposed to traverse the lower surface of the lower flange part 33*b* of the outer bobbin 30 in a direction that is parallel to the terminal connection part 34.

In addition, at least one of both distal ends of the guide block 78 according to the present embodiment may protrude outwardly from the lower flange part 33*b* of the outer bobbin 30. Here, a space between one end of the outwardly protruding guide block 78 and one end of the terminal connection part 34 may be used as the skip groove 72.

The guide block 78 protruding from the lower flange part 33*b* of the outer bobbin 30 may include a catching groove 77 formed at one end thereof. The catching groove 77 opens from one end of the guide block 78 protruding outwardly of the lower flange part 33*b* toward the skip groove 72.

The catching groove 77 may be provided in order to prevent the lead wire 50*b*' from being separated from the skip groove 72 during a process of skipping the lead wire 50*b*' to the coil skip part 170. A detailed description thereof will be provided below.

In the transformer according to the present embodiment, the coil may be wound around the outer winding part 30*a* (please see FIG. 8) and the lead wire 50*b*' of the coil may be skipped to the lower surface of the outer bobbin 30 through the skip groove 72. The entirety of this process may be automatically performed by a separate automatic winding device as described above.

However, a case in which the lead wire 50*b*' of the coil is separated from the skip groove 72 during a process of automatically skipping the lead wire 50*b*' of the coil to the lower surface of the outer bobbin 30 may occur.

Therefore, in the outer bobbin 30 according to the present embodiment, the catching groove 77 may be formed at one end of the guide block 78 in order to prevent the above-mentioned case. Therefore, even though the lead wire 50*b*' of the coil moves during the process of automatically skipping the lead wire 50*b*' of the coil to the lower surface of the outer bobbin 30, it is inserted into the catching groove 77, such that the movement of the lead wire 50*b*' is suppressed. Therefore, separation of the lead wire 50*b*' of the coil from the skip groove 72 may be easily prevented.

The support protrusion 76 according to the present embodiment may protrude in parallel with a plane formed by the lower flange part 33*b*. That is, the support protrusion 76 protrudes laterally of the outer bobbin 30 rather than downwardly thereof.

More specifically, the support protrusion 76 may protrude outwardly of the lower flange part 33*b* in an opposite direction to the catching groove 77 and may serve to support the lead wire 50*b*', similar to the above-mentioned embodiment.

Due to the structure of the support protrusion 76 as described above, the lead wire 50*b*' may be disposed along the traversing route 74, pass through the lower surface of the lower flange part 33*b*, may be wound around the support protrusion 76 in a form in which it is exposed to the outside, and may be then connected to the external connection terminal 36.

Meanwhile, FIGS. 9 and 10 show a case in which the support protrusion 76 protrudes from a portion at which the lower flange part 33*b* and the terminal connection part 34 are connected to each other by way of example. However, the present invention is not limited thereto but may be variously applied. For example, the support protrusion 76 may protrude from the terminal connection part 34 or from the outer peripheral edge of the lower flange part 33*b*.

Further, similar to the above-mentioned embodiment, a contact surface of the support protrusion 76 contacting the lead wire 50*b*' may include a chamfer formed in order to minimize friction between the support protrusion 76 and the lead wire 50*b*', wherein the chamfer has a curved surface or an inclined surface.

A process of disposing the lead wires 50*b*' of the secondary coil 50*b* in the coil skip part 170 according to the present embodiment configured as described above and connecting the lead wire 50*b*' to the external connection terminals 36 will be described below.

The lead wire 50*b*' of the secondary coil 50*b* wound around the outer wiring part 30*a* of the outer bobbin 30 may move to the lower surface of the outer bobbin 30 through the skip groove 72. Here, even though the lead wire 50*b*' moves, the movement of the lead wire 50*b*' is suppressed by the catching groove 77 of the guide block 78, such that the lead wire 50*b*' is stably disposed in the skip groove 72.

In addition, the lead wire 50*b*' skipped to the lower surface of the outer bobbin 30 may be disposed in the traversing route 74 formed on the lower surface of the outer bobbin 30, may traverse the lower surface of the outer bobbin 30 along the traversing route 74, and may then lead to the other side of the outer bobbin 30.

A route of the leaded lead wire 50*b*' may be changed through the support protrusion 76. That is, the lead wire 50*b*' is wound around the support protrusion 76 protruding to the side of the outer bobbin 30, and is then disposed between the guide protrusions 34*a* to thereby be connected to the external connection terminal 36.

As described above, the support protrusion 76 according to the present embodiment may be provided in order to change a disposition route of the lead wires 50*b*' so that the lead wires 50*b*' may be connected to corresponding external connection terminals 36 in the traversing route 74.

In addition, the support protrusion 76 according to the present embodiment may protrude laterally of the outer bobbin 30, whereby a defect that the lead wire 50*b*' wound around the support protrusion 76 is separated from the support protrusion 76 may be basically solved.

Meanwhile, although FIGS. 9 and 10 show a case in which the lead wire 50*b*' is wound around the support protrusion 76 one-half time by way of example, the present invention may be variously applied. Fore example, the lead wire may be wound around the support protrusion 76 several times so that it may be firmly fixed thereto.

Figure 11A:
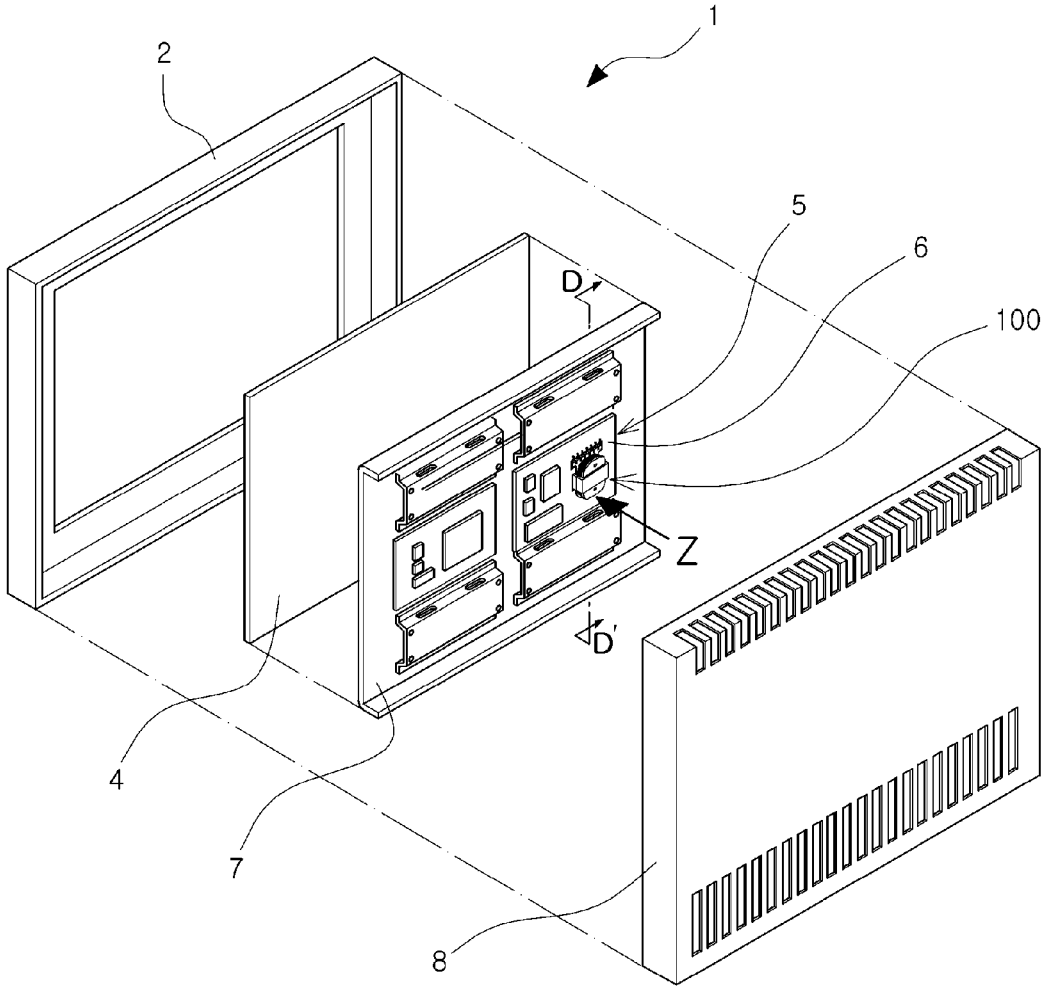
FIG. 11A is an exploded perspective view schematically showing a flat panel display device according to an embodiment of the present invention.
Figure 11B:
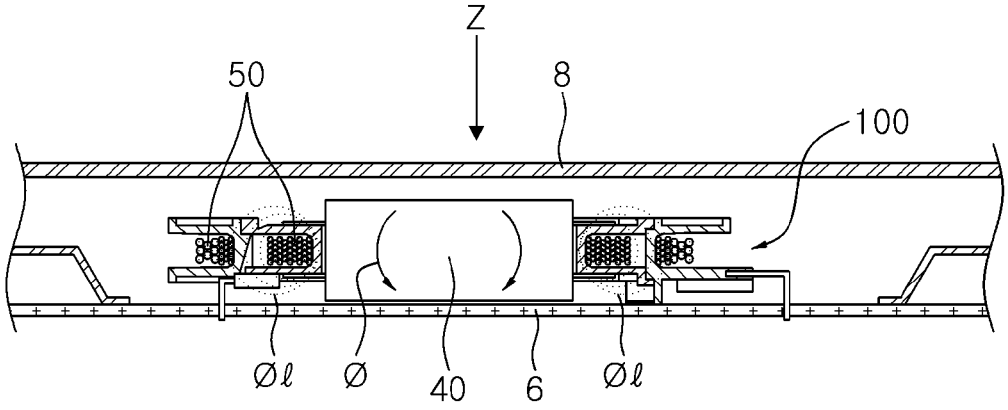
FIG. 11B is a partial cross-sectional view taken along line D-D' of FIG. 11A.

FIG. 11A is an exploded perspective view schematically showing a flat panel display device according to an embodiment of the present invention; and FIG. 11B is a cross-sectional view taken along line D-D' of FIG. 11A.

First referring to FIG. 11A, a flat panel display device 1 according to an embodiment of the present invention may include a display panel 4, a switching mode power supply (SMPS) 5 having the transformer 100 mounted therein, and covers 2 and 8.

The covers 2 and 8 may include a front cover 2 and a back cover 8 and may be coupled to each other to thereby form a space therebetween.

The display panel 4 may be disposed in an internal space formed by the covers 2 and 8. As the display panel, various flat panel display panels such as a liquid crystal display (LCD), a plasma display panel (PDP), an organic light emitting diode (OLED), and the like, may be used.

The SMPS 5 provides power to the display panel 4. The SMPS 5 may be formed by mounting a plurality of electronic components on a printed circuit board 6 thereof and particularly, may include at least one of the transformers according to the above-mentioned embodiments mounted therein. The present embodiment describes a case in which the SMPS includes the transformer 100 of FIG. 1 by way of example.

The SMPS 5 may be fixed to a chassis 7, and be disposed and fixed in the internal space formed by the covers 2 and 8 together with the display panel 4.

As shown in FIG. 11B, in the transformer 100 mounted in the SMPS 5, the coil 50 may be wound in a direction that is parallel to the printed circuit board 6. In addition, when being viewed from a plane of the printed circuit board 6 (a Z direction), the coil 50 is wound clockwise or counterclockwise. Further, a portion (an upper surface) of the core 40 forms a magnetic path while being in parallel with the back cover 8.

Therefore, in the transformer 100 according to the present embodiment, as shown in FIG. 11B, a magnetic path of most of magnetic flux $\phi$ formed between the back cover 8 and the transformer 100 among a magnetic field generated by the coil 50 may be formed in the core 40, whereby the formation of leakage magnetic flux $\phi_1$ between the back cover and the transformer 100 may be significantly reduced.

That is, the transformer 100 according to the present embodiment may be configured so that the coil 50 is wound in a direction that is parallel to the printed circuit board 6, whereby a magnetic path of leakage magnetic flux $\phi_1$ is partially formed to be small without being formed over a space between the transformer 100 and the back cover 8 as in the case according to the related art.

Therefore, even though the transformer 100 according to the present embodiment does not include a separate shielding device (for example, a shielding shield, or the like) on an outer portion thereof, it may minimize the generation of interference between the leakage flux $\phi_1$ and the back cover 8 formed of a metal material.

Therefore, even though the transformer 100 is mounted in a slim electronic device such as the flat panel display device 1, such that the back cover 8 and the transformer 100 have a significantly narrow space therebetween, the generation of noise due to vibrations of the back cover 8 may be prevented.

The transformer disclosed in the present embodiments described above may be configured to be appropriate for an automated manufacturing method.

That is, the transformer according to the present embodiment is completed by individually winding the coils around the inner and outer bobbins, coupling the inner and outer bobbins to each other, and then coupling the core thereto.

As described above, the transformer according to the present invention may be configured so that each of the coils may be wound in a state in which the inner and outer bobbin are separated from each other, in order to automatically wind the primary coil and the secondary coil. Here, the coils may be wound by a separate winding device.

In addition, in the inner and outer bobbins according to the present invention, the lead wires of the automatically wound primary and secondary coils may be primarily fixed by the lead grooves, the guide protrusions, and the like, formed in the terminal connection part and be then connected to the external connection terminals. Therefore, when the lead wires of the coils are connected to the external connection terminals during a process of automatically winding the coils, a phenomenon that they are easily released may be prevented.

In addition, after the winding of the coils is completed, the inner and outer bobbins may be easily coupled to each other through the fitting protrusion and the coupling groove. This process may be automatically performed through a separate device.

As described above, most of a process of manufacturing the transformer according to the present invention may be automated. Therefore, a cost and a time required for manufacturing the transformer may be significantly reduced.

In addition, the transformer according to the present invention may include the coil skip part, which is a route through which the lead wire of the coil traverses the bobbin from the lower surface of the bobbin. That is, in the transformer according to the present invention, the coils may be connected to the external connection terminals through the coil skip part as well as the lead grooves.

Therefore, the lead wires of the coil may be connected to the external connection terminals through more various routes, whereby the generation of a short circuit due to the contact between the lead wires may be prevented.

In addition, the transformer according to the present invention has a significantly reduced thickness. Therefore, it may be easily used in various slim display devices.

Meanwhile, the transformer and the flat panel display device including the same according to the present invention described above are not limited to the aforementioned embodiments but may be variously applied.

For example, the above-mentioned embodiment describes a case in which the coil skip part is formed only in the outer bobbin by way of example, but the present invention is not limited thereto. The coil skip part may be formed in the inner bobbin, similar to the outer bobbin.

In addition, the above-mentioned embodiments describe a case in which the individual bobbins have an approximately rectangular parallelepiped shape. However, the present invention is not limited thereto. The individual bobbins may have various shapes such as a cylindrical shape, or the like, as long as a desired voltage may be drawn.

In addition, although the present embodiment describes the transformer used in the display device by way of example, the present invention is not limited but may be widely applied to a slim electronic device including the transformer.

As set forth above, the transformer according to the embodiment of the present invention may have a structure in which it a plurality of individually divided bobbins (for example, the inner and outer bobbins) and these bobbins are coupled to each other. Therefore, the transformer may be completed by winding the coils around the individual bobbins, respectively, and then coupling the individual bobbins to each other. Therefore, a production process may be automated, whereby costs and a time required for manufacturing the transformer may be significantly reduced.

In addition, the transformer according to the present invention may include the coil skip part, which is a route through which the lead wire of the coil traverses the bobbin from the lower surface of the bobbin. That is, in the transformer according to the present invention, the coils may be connected to the external connection terminals through the coil skip part as well as the lead grooves of the terminal connection part.

Therefore, the lead wires of the coil may be connected to the external connection terminals through more various routes, whereby the generation of a short circuit due to the contact between the lead wires may be prevented.

In addition, when the transformer according to the embodiment of the present invention is mounted on the substrate, the coil of the transformer is maintained in a state in which it is wound in parallel with the substrate. When the coil is wound parallel to the substrate as described above, interference between the leakage magnetic flux generated from the transformer and the outside may be significantly reduced.

Therefore, even though the transformer is mounted in the slim display device, the generation of interference between the leakage magnetic flux generated from the transformer and the back cover of the display device may be significantly reduced. Therefore, a phenomenon in which noise is generated in the display device by the transformer may be prevented. Therefore, the transformer may be easily used in slim display devices.

While the present invention has been shown and described in connection with the embodiments, it will be apparent to those skilled in the art that modifications and variations can be made without departing from the spirit and scope of the invention as defined by the appended claims.

What is claimed is:

1. A transformer comprising:

a bobbin part including a plurality of bobbins, each including a pipe shaped body part having a though-hole formed in an inner part thereof and a flange part protruding outwardly from both ends of the body part;

coils respectively wound around the bobbins; and a core electromagnetically coupled to the coils to thereby form a magnetic path, wherein at least one of the bobbins includes a coil skip part which is a route through which lead wires of the coil skipped through the flange part is disposed on an outer surface of the flange part, wherein the coil skip part includes:

a skip groove, a route by which the lead wires of the coil wound around the body part move to an outer surface of the flange part; and a traversing route, a route disposed so that the lead wires skipped through the skip groove traverse a lower surface of the flange part.

2. The transformer of claim 1, wherein each of the bobbins includes a terminal connection part protruding from one end of at least one flange part and having a plurality of external connection terminals connected thereto.

3. The transformer of claim 2, wherein the coil skip part is a route formed between the terminal connection part and a guide block protruding from the outer surface of the flange part in parallel with the terminal connection part.

4. The transformer of claim 3, wherein the guide block has one end protruding outwardly from an outer peripheral edge of the flange part, and the skip groove is a groove formed by one end of the guide block, the terminal connection part, and the flange part.

5. The transformer of claim 4, wherein the terminal connection part includes a plurality of lead grooves formed in spaces between the external connection terminals, and the plurality of lead wires are connected to the external connection terminals while passing through the skip groove or the lead groove.

6. The transformer of claim 3, further comprising at least one support protrusion protruding outwardly from the traversing route or the terminal connection part, wherein the lead wires are disposed in a changed direction while supporting the support protrusion.

7. The transformer of claim 6, wherein the support protrusion protrudes in parallel with a plane formed by the flange part.

8. The transformer of claim 6, wherein the support protrusion protrudes perpendicularly to a plane formed by the flange part.

9. The transformer of claim 6, wherein the support protrusion protrudes so that a contact surface between the support protrusion and the lead wire forms a right angle or an acute angle with the flange part.

10. The transformer of claim 6, wherein the guide block is formed so that a spaced distance between the guide block and the terminal connection part increases corresponding to a position at which the support protrusion is formed.

11. The transformer of claim 6, wherein the support protrusion includes a chamfer formed at a position at which it contacts the lead wire.

12. The transformer of claim 4, wherein the guide block includes a catching groove opened from one end of an outwardly protruding part of the flange part toward the skip groove.

13. The transformer of claim 1, wherein the bobbin part includes:

an outer bobbin including the coil skip part; and an inner bobbin inserted into and coupled to the through-hole of the outer bobbin.

14. A transformer comprising:

a bobbin part including a plurality of bobbins, each including a pipe shaped body part having a though-hole formed in an inner part thereof and a flange part protruding outwardly from both ends of the body part;

external connection terminals connected to one end of at least one of the flange parts; and at least one coil wound in a space formed by an outer peripheral surface of the body part and one surface of the flange part, wherein at least one of the bobbins includes a coil skip part including a skip groove, a route through which the lead wires move to an outer surface of the flange part and a traversing route, a route disposed so that the lead wires skipped through the skip groove traverse the other surface of the flange part, wherein lead wires of the coil are connected to the external connection terminals while being distributed by the coil skip part in order to prevent an intersection therebetween.

15. The transformer of claim 14, wherein at least one of the bobbins includes a terminal connection part protruding from one end of the flange part and including a plurality of external connection terminals connected thereto and a plurality of lead grooves formed in spaces between the external connection terminals, the lead groove including the lead wire disposed therein.

* * * * *